US010773919B2

(12) United States Patent
Nishimura

(10) Patent No.: US 10,773,919 B2
(45) Date of Patent: Sep. 15, 2020

(54) SHEET HANDLING APPARATUS AND SHEET HANDLING METHOD

(71) Applicant: GLORY LTD., Hyogo (JP)

(72) Inventor: Kazuaki Nishimura, Himeji (JP)

(73) Assignee: GLORY LTD., Hyogo (JP)

( * ) Notice: Subject to any disclaimer, the term of this patent is extended or adjusted under 35 U.S.C. 154(b) by 6 days.

(21) Appl. No.: 16/138,398

(22) Filed: Sep. 21, 2018

(65) Prior Publication Data

US 2019/0092598 A1 Mar. 28, 2019

(30) Foreign Application Priority Data

Sep. 26, 2017 (JP) ..... 2017-184673

(51) Int. Cl.

| | |
|---|---|
| ***B65H 43/06*** | (2006.01) |
| ***G07D 11/125*** | (2019.01) |
| ***G07D 11/23*** | (2019.01) |
| ***B65H 29/46*** | (2006.01) |
| ***B65H 31/22*** | (2006.01) |

(52) U.S. Cl.

CPC ..... *B65H 43/06* (2013.01); *B65H 29/46* (2013.01); *B65H 31/22* (2013.01); *G07D 11/125* (2019.01); *G07D 11/23* (2019.01)

(58) Field of Classification Search

CPC ..... B65H 31/3045; B65H 43/06; B65H 29/34
See application file for complete search history.

(56) References Cited

U.S. PATENT DOCUMENTS

| | | | | |
|---|---|---|---|---|
| 5,676,366 | A * | 10/1997 | Polidoro | B65H 29/46 271/176 |
| 2016/0031574 | A1* | 2/2016 | Razzaboni | B65B 7/02 53/268 |
| 2018/0029730 | A1* | 2/2018 | Yokoo | B65H 31/34 |
| 2019/0279453 | A1* | 9/2019 | Yokoo | B65H 29/46 |

FOREIGN PATENT DOCUMENTS

| | | | |
|---|---|---|---|
| EP | 2736025 | | 5/2014 |
| GB | 2489694 | A | 10/2012 |
| JP | 63117874 | A * | 5/1988 |
| JP | 2008171334 | A * | 7/2008 |
| WO | 2005/064553 | | 7/2005 |
| WO | 2012061851 | A1 | 5/2012 |
| WO | WO2016/136517 | | 9/2016 |

OTHER PUBLICATIONS

Extended European Search Report, dated Jan. 30, 2019, from the European Patent Office (EPO) for the corresponding European Patent Application No. 18196738.1.

European Office Action, European Patent Office, Application No. 18196738.1, dated Nov. 21, 2019.

* cited by examiner

*Primary Examiner* — Howard J Sanders

(74) *Attorney, Agent, or Firm* — Greenblum & Bernstein, P.L.C.

(57) ABSTRACT

A controller of a sheet handling apparatus (for example, banknote handling machine) stops an operation of storing a sheet in a storage bag (for example, banknote storage bag) on the condition that the number of sheets (for example, banknotes) received by a number information receiver is less than a predetermined number, when a distance between a receiver (for example, each stage) and a presser (for example, pressing plate) that is pressing the sheets stored in a storage bag which is supported by a support (for example, (Continued)

each holding member), toward the receiver, is greater than a predetermined distance.

9 Claims, 13 Drawing Sheets

SHEET HANDLING APPARATUS AND SHEET HANDLING METHOD

CROSS-REFERENCE TO RELATED APPLICATION

This application claims priority to Japanese Patent Application No. 2017-184673 filed on Sep. 26, 2017, the entire contents of which are incorporated herein by reference.

BACKGROUND OF THE INVENTION

1. Field of the Invention

The present invention relates to a sheet handling apparatus and a sheet handling method for storing sheets in a storage bag having an opening.

2. Description of the Related Art

To date, as a sheet handling apparatus for performing depositing of sheets such as banknotes, such an apparatus that stores sheets taken into the apparatus, in a storage bag such as a pouch, has been used. For example, such a sheet handling apparatus is used as a part of a cash handling machine installed in a back office region of a store such as a supermarket. The cash handling machine performs withdrawing of money as change funds with which a cash settlement machine disposed in a front office region is to be replenished, and performs depositing of money as proceeds, from sales, collected from the cash settlement machine. Such a sheet handling apparatus is disclosed in, for example, WO2016/136517.

The banknote handling apparatus disclosed in WO2016/136517 has a banknote storing mechanism for storing banknotes in a layered state in a storage bag having an opening on one side. More specifically, the banknote storing mechanism has a pair of holding members that are spaced so as to face each other, and two portions, near the opening of the storage bag, which face each other are held by the holding members, respectively. Furthermore, the holding members have heating members, respectively. A predetermined number of banknotes are stored in a layered state in the storage bag held by the holding members in the banknote storing mechanism. Thereafter, one of the holding members is moved toward the other of the holding members, a portion, near the opening, of the storage bag is heated by the heating members in a state where the holding members are in contact with each other, the opening of the storage bag is heat-sealed, and the storage bag is thereafter taken out from the banknote storing mechanism. Furthermore, the banknote storing mechanism has a stage on which the bottom of the storage bag held by the pair of holding members is placed. The stage is slightly moved downward each time a banknote is stored in the storage bag held by the pair of holding members, whereby a space in which banknotes are stored in the storage bag is assured.

In the banknote handling apparatus disclosed in WO2016/136517, the banknote storing mechanism has a pressing plate that is moved into the storage bag held by the pair of holding members and presses banknotes stored in the storage bag, toward the stage. The banknotes stored in the storage bag are pressed toward the stage by the pressing plate, whereby a plurality of banknotes stored in the storage bag can be compressed in the layering direction, so that the increased number of banknotes can be stored in the storage bag.

SUMMARY OF THE INVENTION

In the conventional banknote handling apparatus as disclosed in, for example, WO2016/136517, in a case where banknotes to be stored in the storage bag are not brand-new notes but wrinkled banknotes, when the pressing plate presses the banknotes and thereafter retracts outward from the storage bag, a plurality of banknotes stored in the storage bag may expand in the layering direction. In the conventional banknote handling apparatus as described above, when the stage reaches a predetermined position, the storage bag is determined as being in nearly full state of banknotes or full state of banknotes, and the opening of the storage bag is heat-sealed by the heating member. However, in a case where banknotes to be stored in the storage bag are not brand-new notes but wrinkled banknotes, if the pressing plate retracts outward from the storage bag and a plurality of banknotes stored in the storage bag expands in the layering direction, when the opening of the storage bag is heat-sealed by the heating member, the banknote in the storage bag may contact with the heating member, so that the poor sealing may occur. When the poor sealing occurs in such a manner, a part of the opening of the storage bag may not be sealed. Therefore, a problem arises that a banknote in the storage bag may be extracted from the unsealed portion.

The present invention has been made in view of such a problem, and an object of the present invention is to provide a sheet handling apparatus and a sheet handling method that prevent occurrence of poor sealing due to a sheet in a storage bag contacting with a sealing member when an opening of the storage bag is sealed even in a case where wrinkled sheets are stored in the storage bag.

A sheet handling apparatus of the present invention for storing a sheet in a storage bag having an opening, the sheet handling apparatus includes: a support configured to support a portion, near the opening, of the storage bag; a receiver configured to receive a part of the storage bag supported by the support; a driver configured to move the receiver in a layering direction of sheets stored in the storage bag; a number information receiver configured to receive information on the number of sheets stored in the storage bag; a presser configured to move into the storage bag supported by the support, and press sheets stored in the storage bag toward the receiver; and a controller configured to control the presser and the driver, and the controller stops an operation of storing a sheet in the storage bag on a condition that the number of sheets received by the number information receiver is less than a predetermined number, when a distance between the receiver and the presser that is pressing the sheets stored in the storage bag toward the receiver, is greater than a predetermined distance.

The sheet handling apparatus of the present invention may further include: a temporary storage configured to temporarily store sheets to be stored in the storage bag; and a sheet sender configured to send a sheet to the temporary storage, a sheet released from the temporary storage may be stored in the storage bag supported by the support, and the controller may control the sheet sender such that, in a case where a distance between the receiver and the presser that is pressing sheets stored in the storage bag which is supported by the support, toward the receiver, is greater than the predetermined distance, when the number of the sheets received by the number information receiver is less than the predetermined number, no sheet is sent to the temporary storage.

In the sheet handling apparatus of the present invention, the controller may control the driver such that the receiver is moved so as to be distant from the support on the condition that the number of sheets received by the number information receiver is less than the predetermined number, when a distance between the receiver and the presser that is pressing the sheets stored in the storage bag which is supported by the support, toward the receiver, is greater than the predetermined distance.

In this case, the receiver may be moved so as to be distant from the support and to be close to the support in a predetermined movement range, the controller may control the driver such that the receiver is moved so as to be farthest from the support in the predetermined movement range on the condition that the number of sheets received by the number information receiver is less than the predetermined number, when a distance between the receiver and the presser that is pressing the sheets stored in the storage bag which is supported by the support, toward the receiver, is greater than the predetermined distance, and in a case where a distance between the receiver and the presser that is pressing sheets stored in the storage bag which is supported by the support, toward the receiver, is greater than the predetermined distance, when the receiver reaches a first predetermined position, if the number of the sheets received by the number information receiver is greater than the predetermined number, the controller may control the driver such that the receiver is moved so as to be farthest from the support in the predetermined movement range.

In the sheet handling apparatus of the present invention, the controller may control the driver such that the receiver is moved so as to be distant from the support in a state where sheets are gripped between the presser and the receiver until the presser reaches a second predetermined position when the sheets stored in the storage bag that is supported by the support are pressed toward the receiver by the presser.

In this case, the presser may be moved between a retracting position that is upward of the storage bag supported by the support and a lower end position in the storage bag, supported by the support, into which the presser is moved, and the second predetermined position may be the lower end position.

The sheet handling apparatus of the present invention may further include: a detector for detecting whether or not the presser is at the lower end position.

In this case, the controller may control the driver such that the receiver is moved so as to be distant from the support when the detector does not detect that the presser is at the lower end position in a case where the presser is moved into the storage bag, and contacts with sheets stored in the storage bag.

The sheet handling apparatus of the present invention may further include a recognizer configured to perform recognition of a sheet to be stored in the storage bag, and the number of sheets sent to the storage bag may be calculated based on a recognition result by the recognizer, and information on the calculated number of the sheets is received by the number information receiver.

The sheet handling apparatus of the present invention may further include a parameter setter configured to set at least one of the predetermined distance and the predetermined number.

The sheet handling apparatus of the present invention may further include a process mode setter configured to set one of a first process mode and a second process mode, as a process mode for an operation of storing a sheet in the storage bag supported by the support, and: in a case where the process mode setter sets the first process mode for performing the operation of storing the sheet in the storage bag, the controller may stop the operation of storing the sheet in the storage bag on the condition that the number of sheets received by the number information receiver is less than the predetermined number, when a distance between the receiver and the presser that is pressing the sheets stored in the storage bag which is supported by the support, toward the receiver, is greater than the predetermined distance, and in a case where the process mode setter sets the second process mode for performing the operation of storing the sheet in the storage bag, the controller may not stop the operation of storing the sheet in the storage bag even if the number of sheets received by the number information receiver is less than the predetermined number when the distance between the receiver and the presser that is pressing the sheets stored in the storage bag which is supported by the support, toward the receiver, is greater than the predetermined distance.

A sheet storing method of the present invention for storing a sheet in a storage bag having an opening through which the sheet is inserted includes: supporting a portion, near the opening, of the storage bag by a support; receiving, by a receiver, a part of the storage bag supported by the support; storing a sheet in the storage bag supported by the support; receiving information on the number of sheets stored in the storage bag; and pressing, by a presser, sheets stored in the storage bag that is supported by the support, toward the receiver, by moving the presser in the storage bag, and an operation of storing the sheet in the storage bag is stopped on the condition that the number of sheets having been received is less than a predetermined number, when a distance between the receiver and the presser that is pressing the sheets stored in the storage bag which is supported by the support, toward the receiver, is greater than a predetermined distance.

BRIEF DESCRIPTION OF THE DRAWINGS

FIG. 4 is a perspective view of a configuration of a storage bag to be held by each holding member in the banknote storing mechanism shown in FIG. 2 and the like;

FIG. 5 is a perspective view illustrating a state where the storage bag is held by each holding member in the banknote storing mechanism shown in FIG. 2 and the like;

FIG. 8 is a perspective view of a configuration of a pantograph and the like for moving the pressing plate in the banknote storing mechanism shown in FIG. 2 and the like;

FIG. 9 is a perspective view of a configuration of a motor, a gear, and the like for moving the pantograph in the banknote storing mechanism shown in FIG. 2 and the like;

FIG. 10 is a functional block diagram illustrating a configuration of a control system in the banknote handling machine shown in FIG. 1 and the like; and FIG. 11A to FIG. 11E are each a side view schematically illustrating an operation of storing banknotes in the storage bag in the banknote storing mechanism shown in FIG. 2 and the like.

DESCRIPTION OF THE PREFERRED EMBODIMENTS

Figure 5:
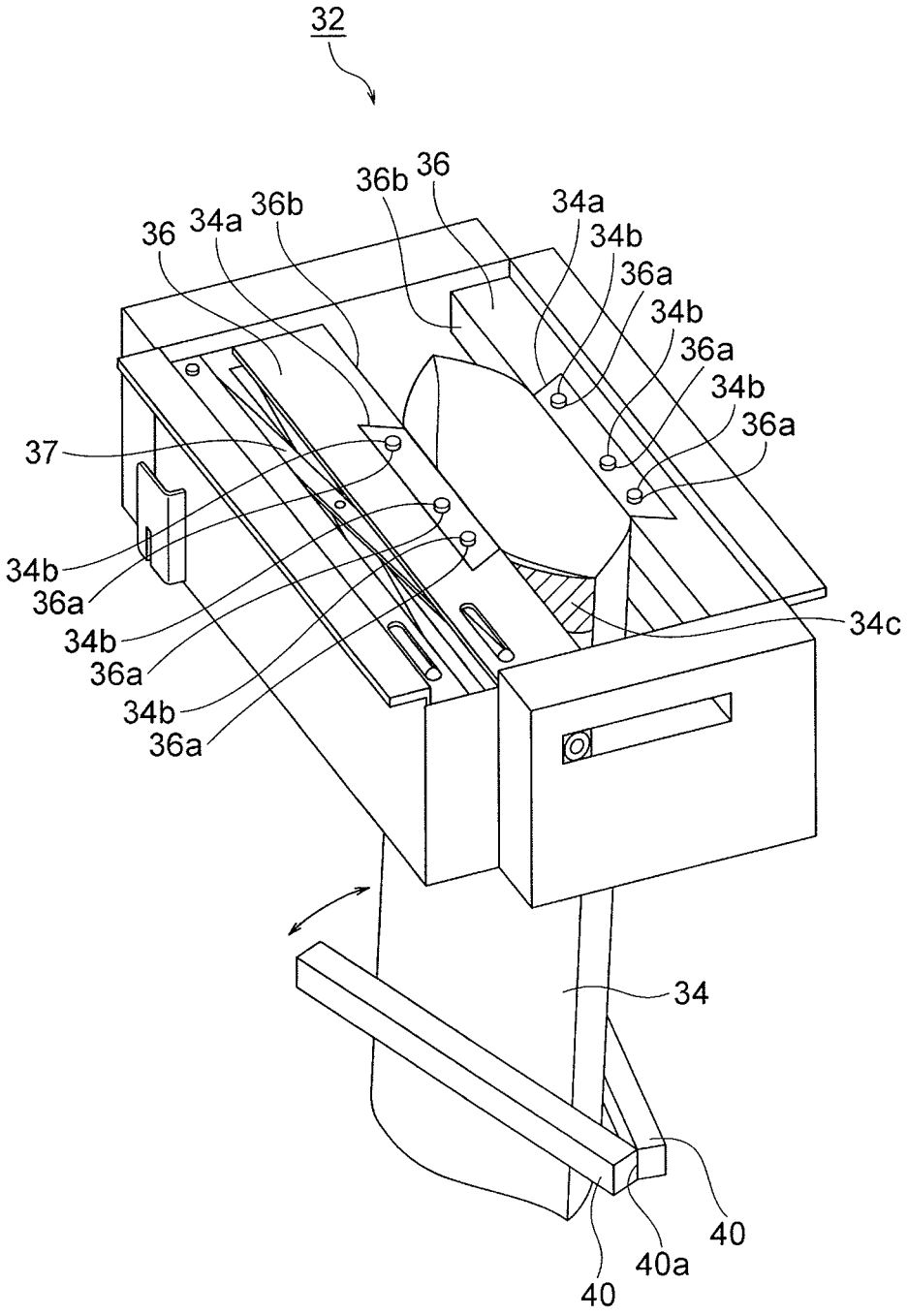
Figure 6:
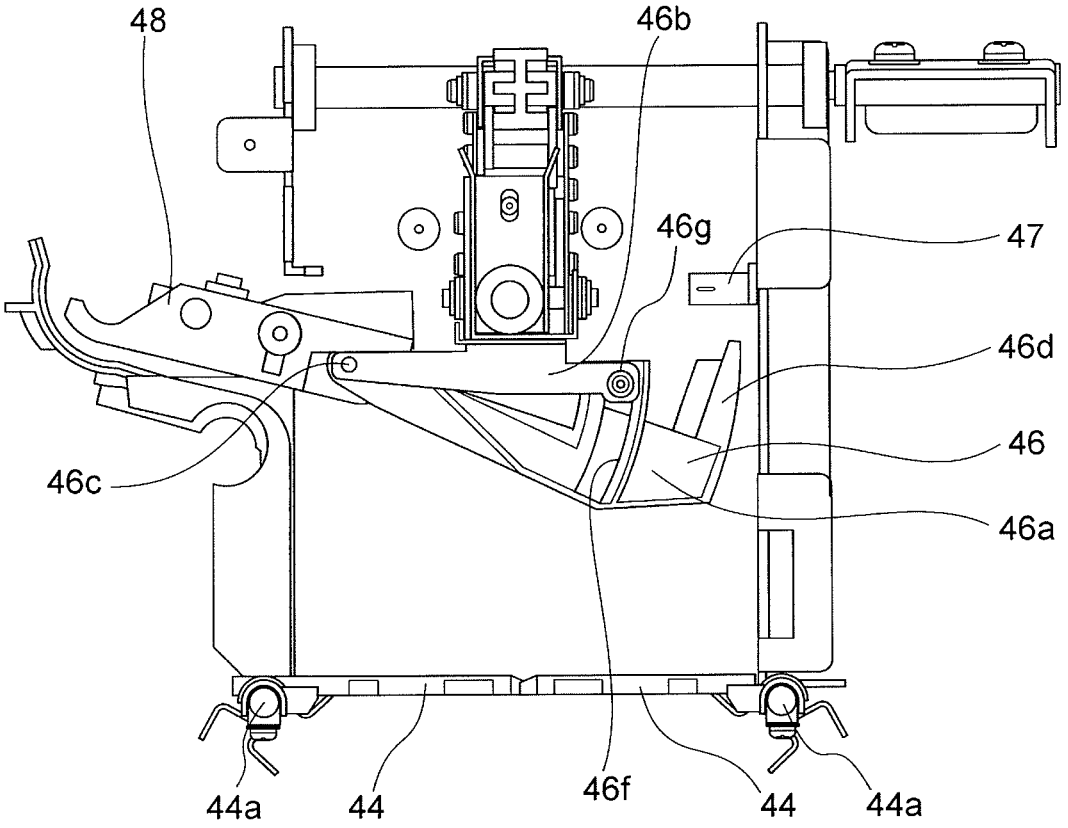
FIG. 6 is a side view of a configuration of a pressing plate, a temporary storage, and the like in the banknote storing mechanism shown in FIG. 2 and the like, in a state where no banknote is stored on the temporary storage.
Figure 7:
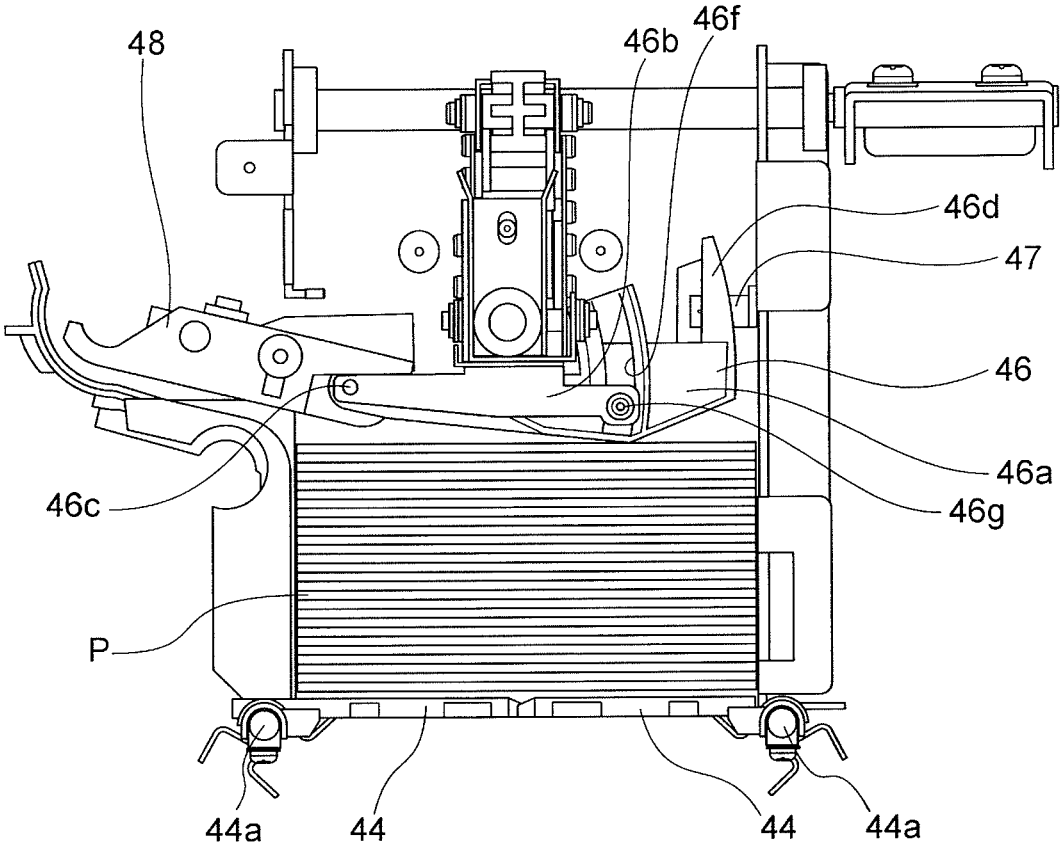
FIG. 7 is a side view of a configuration of the pressing plate, the temporary storage, and the like in the banknote storing mechanism shown in FIG. 2 and the like, in a state where the temporary storage is in full state of banknotes or nearly full state of banknotes.

An embodiment of the present invention in which a banknote handling machine that performs handling of banknotes is used as a sheet handling apparatus according to the present invention will be described below. FIG. 1 to FIG. 11 illustrate the banknote handling machine according to the present embodiment. In FIG. 7 and FIG. 11, reference character P, Pa, Pb represents a plurality of banknotes in a layered state.

Figure 1:
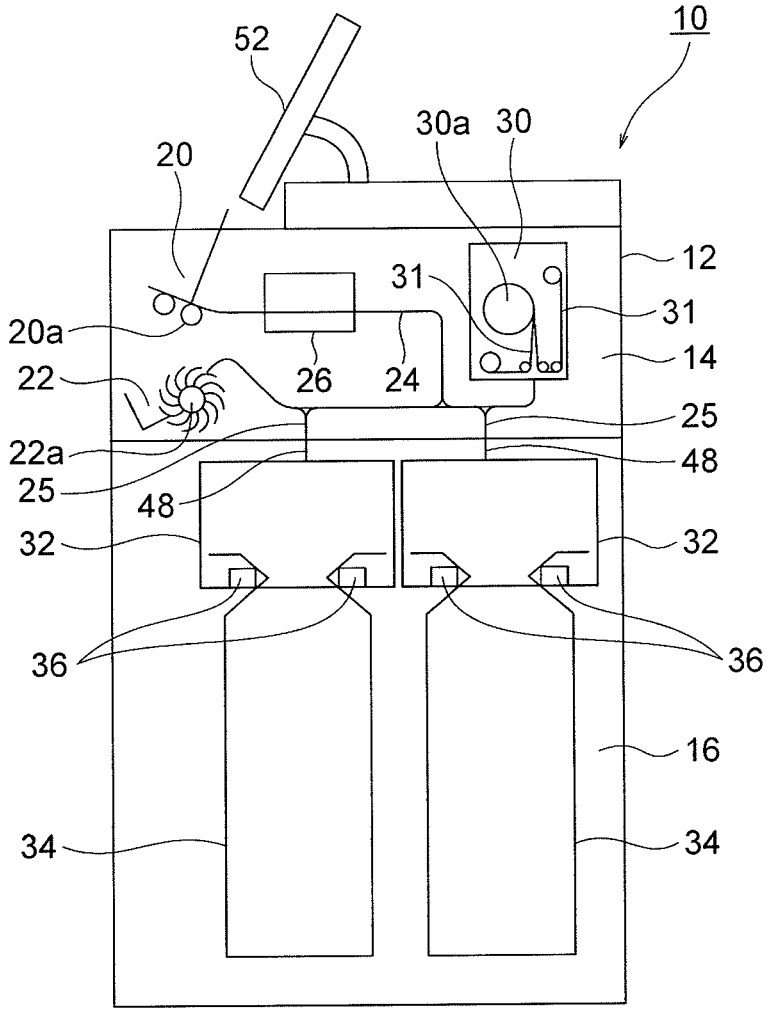
FIG. 1 schematically illustrates an internal configuration of a banknote handling machine according to an embodiment of the present invention.

A banknote handling machine 10 according to the present embodiment is disposed in a front office region or a back office region in a store such as a supermarket, in a bank lobby, or inside a bank, in general. The banknote handling machine 10 can perform various handlings such as depositing of banknotes. As shown in FIG. 1, the banknote handling machine 10 of the present embodiment has an almost rectangular-parallelepiped-shaped housing 12. In FIG. 1, the surface, of the housing 12, on the left side is a front surface (that is, a surface which an operator faces) of the housing 12. In the housing 12, an upper unit assembly 14 and a lower unit assembly 16 are accommodated so as to be drawn forward (specifically, leftward in FIG. 1) from the front surface of the housing 12. In the upper unit assembly 14, an inlet 20 such as a receptacle hopper through which a banknote is inserted into the housing 12 from the outside is disposed on the upper front surface (the upper portion on the left side surface in FIG. 1) of the housing 12. Furthermore, in the upper unit assembly 14, an outlet unit 22 for discharging a banknote from the housing 12 to the outside is disposed below the inlet 20 on the front surface (the surface on the left side in FIG. 1) of the housing 12.

The inlet 20 has a banknote feeding mechanism 20*a* for feeding out banknotes placed in the inlet 20 in a layered state by an operator, one by one, into the housing 12. In the upper unit assembly 14, a transporter 24 for transporting banknotes one by one in the housing 12 is disposed in the housing 12 of the banknote handling machine 10, and the banknotes fed out from the inlet 20 by the banknote feeding mechanism 20*a* are transported one by one by the transporter 24. In the transporter 24, a recognizer 26 is disposed, and the recognizer 26 performs recognition of a denomination, authentication, face/back, fitness, new/old, a transport state, and the like for a banknote fed out to the transporter 24 by the banknote feeding mechanism 20*a*.

As shown in FIG. 1, the outlet unit 22 is connected to the transporter 24, and banknotes transported to the outlet unit 22 from the transporter 24 are stacked in the outlet unit 22. The outlet unit 22 can be accessed from the outside of the housing 12, and an operator is allowed to take out the banknotes stacked in the outlet unit 22 from the front surface of the housing 12. A stacking wheel 22*a* is disposed at a portion of the transporter 24 at which the transporter 24 is connected to the outlet unit 22, and the stacking wheel 22*a* rotates in the counterclockwise direction in FIG. 1. When a banknote is transported from the transporter 24 to the outlet unit 22, the stacking wheel 22*a* rotates in the counterclockwise direction in FIG. 1 in a state where the banknote is gripped between two vanes of the stacking wheel 22*a*, whereby the banknote gripped between the two vanes of the stacking wheel 22*a* can be stacked in the outlet unit 22 in an aligned state.

In the upper unit assembly 14, a tape-type storage/feeding unit 30 is disposed at the transporter 24, and a banknote transported from the transporter 24 to the storage/feeding unit 30 is stored in the storage/feeding unit 30 and banknotes stored in the storage/feeding unit 30 can be fed out one by one to the transporter 24. More specifically, the storage/feeding unit 30 has a drum 30*a* that can perform both forward rotation and reverse rotation, and one end of a pair of band-like tapes 31 is connected to the outer circumferential surface of the drum 30*a*. When banknotes are transported from the transporter 24 to the storage/feeding unit 30, both the banknotes and the tapes 31 are wound on the drum 30*a* one by one by the band-like tapes 31. Meanwhile, when each tape 31 is wound back from the drum 30*a* by reverse rotation of the drum 30*a*, the banknote wound on the drum 30*a* is also released from each tape 31 and fed out to the transporter 24.

Figure 2:
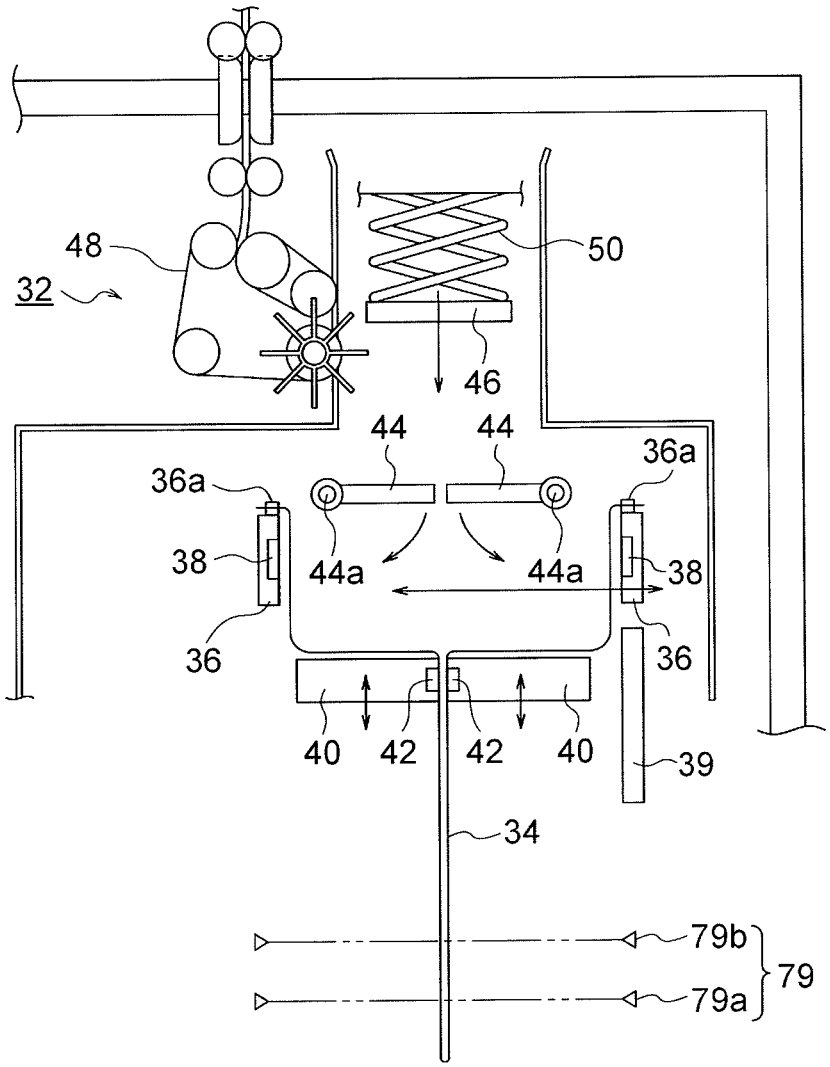
FIG. 2 is a side view showing in detail a configuration of a banknote storing mechanism in the banknote handling machine shown in FIG. 1.

As shown in FIG. 1, in the present embodiment, the lower unit assembly 16 has a plurality (for example, two) of banknote storing mechanisms 32 each of which stores banknotes in a banknote storage bag 34 having, on one side, an opening through which a banknote is inserted. Each banknote storing mechanism 32 has a pair of holding members 36 that are spaced so as to face each other, and two portions, near an opening of each banknote storage bag 34, which face each other are held by the holding members 36, respectively. One of the holding members 36 (specifically, for example, the holding member 36 on the right side in FIG. 1 and FIG. 2) is fixedly positioned, whereas the other of the holding members 36 (specifically, for example, the holding member 36 on the left side in FIG. 1 and FIG. 2) can be moved toward the holding member 36 that is fixedly positioned. As shown in FIG. 2, each holding member 36 has a heater 38. After a predetermined number of banknotes are stored in the banknote storage bag 34 held by each holding member 36 in the banknote storing mechanism 32, before the banknote storage bag 34 is taken out from the banknote storing mechanism 32, one of the holding members 36 is moved toward the other of the holding members 36, and a portion, near the opening, of the banknote storage bag 34 is heated by the heater 38 in a state where the holding members 36 are joined to each other, whereby the opening of the banknote storage bag 34 is heat-sealed. In the banknote storing mechanism 32, instead of one of the paired holding members 36 being moved toward the other of the holding members 36, both the holding members 36 may be moved toward each other up to the center position, and the holding members 36 may be joined to each other at the center position.

In the upper unit assembly 14, a plurality (two in the example shown in FIG. 1) of diverging transporters 25 diverges from the transporter 24 so as to correspond to the banknote storing mechanisms 32, respectively, and a banknote which is diverted from the transporter 24 to the diverging transporter 25 is transported from the diverging transporter 25 to the banknote storage bag 34 mounted to the banknote storing mechanism 32, and stored in the banknote storage bag 34.

Figure 3:
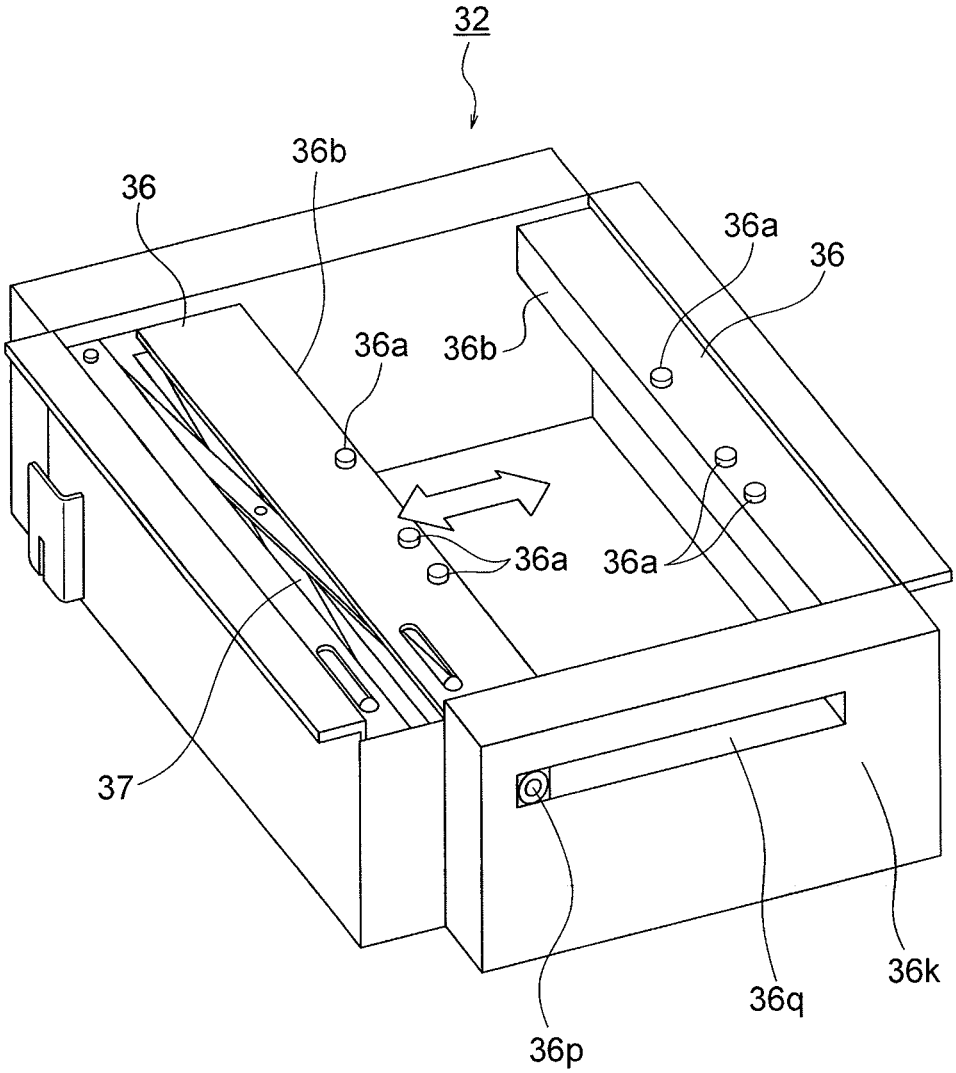
FIG. 3 is a perspective view of a configuration of a pair of holding members and the like in the banknote storing mechanism shown in FIG. 2.
Figure 4:
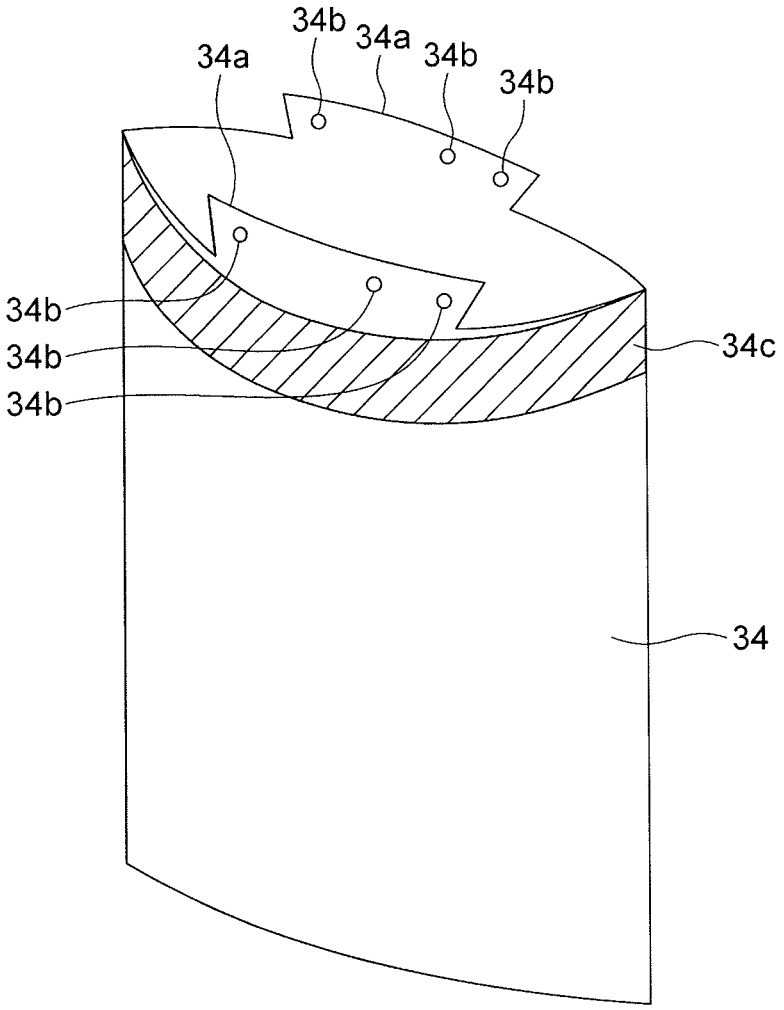

Next, a configuration of the banknote storing mechanism 32 according to the present embodiment will be described in detail with reference to FIG. 2 to FIG. 5. FIG. 2 is a side view showing in detail the configuration of the banknote storing mechanism 32. FIG. 3 is a perspective view of a configuration of the pair of holding members 36 and the like in the banknote storing mechanism 32 shown in FIG. 2. FIG. 4 is a perspective view of a configuration of the banknote storage bag 34 to be held by each holding member 36 in banknote storing mechanism 32 shown in FIG. 2 and the like. FIG. 5 is a perspective view illustrating a state where the banknote storage bag 34 is held by each holding member 36 in the banknote storing mechanism 32 shown in FIG. 2 and the like.

As shown in FIG. 2, the banknote storing mechanism 32 has: a banknote sending-out unit 48 for sending a banknote transported from the diverging transporter 25 of the upper unit assembly 14 to the lower unit assembly 16, to the banknote storage bag 34 held by the pair of holding members 36; a temporary storage 44 for temporarily storing a banknote sent by the banknote sending-out unit 48; and a stage 40 on which the bottom of the banknote storage bag 34 held by the pair of holding members 36 is placed.

As shown in FIG. 2, the banknote sending-out unit 48 uses a roller and a belt in combination, and sends banknotes transported from the diverging transporter 25 of the upper unit assembly 14 to the lower unit assembly 16 one by one to the temporary storage 44, to stack the banknotes in the temporary storage 44. Furthermore, the temporary storage 44 is implemented by a pair of left and right temporary storage, and each temporary storage 44 can rotate about a shaft 44*a* disposed at the proximal end portion of the temporary storage 44 in the downward direction (that is, directions indicated by arrows in FIG. 2).

As shown in FIG. 2, in the banknote storing mechanism 32, the stage 40 on which at least a part of the banknote storage bag 34 held by the holding members 36 is placed, is disposed. The stage 40 is implemented by a pair of left and right stages. Each stage 40 can be moved in the up-down direction and the left-right direction in FIG. 2. More specifically, as shown in FIG. 5, the pair of stages 40 are connected to each other by a hinge portion 40*a* disposed at the end portion of each stage 40, and the stages 40 can swing about the hinge portion 40*a* along the horizontal plane in the directions indicated by arrows in FIG. 5. When each stage 40 is opened, a gap is formed between the stages 40. A part of the banknote storage bag 34 held by the holding members 36 can be extended downward from each stage 40 through the gap. Each stage 40 is driven by a stage driver 41 (see FIG. 10) such as an electric actuator. Specifically, the stage driver 41 moves each stage 40 in the up-down direction in FIG. 2, and also opens and closes each stage 40 about the hinge portion 40*a* along the horizontal plane. As described above, the paired stages 40 are connected to each other by the hinge portion 40*a*, and open and close about the hinge portion 40*a*. However, in FIG. 2 and FIG. 11, for convenience sake, the operation of opening and closing of each the stage 40 about the hinge portion 40*a* is indicated as movement of each stage 40 in the left-right direction.

A heater 42 is disposed at each stage 40. Before the banknote storage bag 34 is taken out from the banknote storing mechanism 32, one of the stages 40 (for example, the stage 40 on the right side in FIG. 2) is moved toward the other of the stages 40 (for example, the stage 40 on the left side in FIG. 2), and a portion, of the banknote storage bag 34, which serves as the bottom thereof when banknotes are stored in the banknote storage bag 34 is heated by each heater 42 in a state where the stages 40 are in contact with each other, whereby the portion is heat-sealed. In the banknote storing mechanism 32, instead of one of the paired stages 40 being moved toward the other of the stages 40, both the stages 40 may be moved toward each other, and joined to each other.

As shown in FIG. 3, a pantograph 37 is disposed at the left side holding member 36 among the pair of left and right holding members 36, and the left side holding member 36 is moved toward the right side holding member 36 by the pantograph 37, and the holding members 36 are brought into contact with each other. More specifically, a guide pin 36*p* is disposed at the end portion of the left side holding member 36, and a frame 36*k* that supports each holding member 36 has a linear long hole 36*q* by which the guide pin 36*p* is guided. The long hole 36*q* extends in the frame 36*k* in the horizontal direction. When the pantograph 37 is extended, the guide pin 36*p* disposed at the left side holding member 36 is guided along the long hole 36*q*, whereby the left side holding member 36 is moved toward the right side holding member 36. Thus, a surface 36*b* of the left side holding member 36 is brought into contact with a surface 36*b* of the right side holding member 36. In the banknote storing mechanism 32, instead of one of the paired holding members 36 being moved toward the other of the holding members 36, both the holding members 36 may be moved toward each other up to the center position, whereby the holding members 36 may contact with each other at the center position.

As shown in FIG. 3, three pins 36*a* are disposed on the upper surface of each of the paired left and right holding members 36. As shown in FIG. 4, paired protrusions 34*a* each having three openings 34*b* are disposed at portions (that is, the upper end portion of the banknote storage bag 34), near the opening, of the banknote storage bag 34 to be held by each holding member 36. When the banknote storage bag 34 is held by each holding member 36, the pins 36*a* of the holding members 36 pass through the openings 34*b*, respectively, disposed in the protrusions 34*a* of the banknote storage bag 34, whereby the protrusions 34*a* are held by the holding members 36, respectively.

As shown in FIG. 4 and the like, a band-like reinforcing member 34*c* is disposed at a portion, near the opening, on the outer surface of the banknote storage bag 34. The reinforcing member 34*c* is formed from polyethylene terephthalate having strong stiffness as compared to the banknote storage bag 34. By the reinforcing member 34*c*, force thus acts so as to prevent wrinkling at the opening of the banknote storage bag 34. In the description herein, "strong stiffness" means that stiffness is high with respect to bending. A reinforcing member that is limper than the banknote storage bag 34 may be used as the reinforcing member 34*c*. Also in this case, since the reinforcing member 34*c* which is another member is disposed at (attached to) the banknote storage bag 34, stiffness near the opening becomes strong over the entirety, and wrinkling at the opening can be inhibited.

As shown in FIG. 2, a pressing plate 46 is disposed above the pair of temporary storage 44. The pressing plate 46 has a pantograph 50, and the pantograph 50 extends and contracts in the up-down direction in FIG. 2, whereby the pressing plate 46 can be moved in a range indicated by an arrow in FIG. 2 in the up-down direction. Since the pressing plate 46 is thus moved downward, when banknotes temporarily stored on each temporary storage 44 are stored in the banknote storage bag 34, the banknotes on each temporary storage 44 can be pushed toward the banknote storage bag 34 in the stacked state.

A configuration of the pressing plate 46 will be described in detail with reference to FIG. 6 and FIG. 7. FIG. 6 and FIG. 7 are each a side view of the configuration of the pressing plate 46, the pair of the temporary storage 44, and the like in the banknote storing mechanism 32 shown in FIG. 2. FIG. 6 illustrates a state where no banknote is stored in the temporary storage 44. FIG. 7 illustrates a state where the temporary storage 44 is in full state of banknotes or nearly full state of banknotes.

As shown in FIG. 6 and FIG. 7, the pressing plate 46 has a pushing portion 46*a* and a base portion 46*b*. The pushing portion 46*a* can swing about a shaft 46*c* with respect to the base portion 46*b*. More specifically, the pushing portion 46*a* has an arc-shaped guide hole 46*f*, and the base portion 46*b* has a pin member 46*g* to be inserted into the guide hole 46*f* of the pushing portion 46*a*. The pushing portion 46*a* swings about the shaft 46*c* with respect to the base portion 46*b* in a range in which the pin member 46*g* moves relative to the guide hole 46*f*. In a case where no force is applied to the pushing portion 46*a*, the pushing portion 46*a* is maintained so as to protrude downward relative to the base portion 46*b* due to its own weight as shown in FIG. 6. Meanwhile, when the pushing portion 46*a* is pressed upward by banknotes stored on each temporary storage 44, the pushing portion 46*a* in a state shown in FIG. 6 rotates about the shaft 46*c* in the counterclockwise direction in FIG. 6, and the pushing portion 46*a* retracts upward relative to the base portion 46*b* as shown in FIG. 7.

As shown in FIG. 6 and FIG. 7, a to-be-detected member 46*d* is mounted to the upper portion of the pushing portion 46*a*, and a detection sensor 47 for detecting for the to-be-detected member 46*d* is disposed. The detection sensor 47 is fixedly positioned. In a case where the pressing plate 46 is positioned as shown in FIG. 6 or FIG. 7, when the pushing portion 46*a* is pressed upward by banknotes stored on each temporary storage 44, and the pushing portion 46*a* rotates about the shaft 46*c* in the counterclockwise direction in FIG. 6 or FIG. 7, the to-be-detected member 46*d* mounted to the pushing portion 46*a* is detected by the detection sensor 47. Thus, the detection sensor 47 detects that the pushing portion 46*a* rotates about the shaft 46*c* upward relative to the base portion 46*b*. The detection sensor 47 may not be fixedly positioned. In another example, the detection sensor 47 and the pressing plate 46 may integrally move in the up-down direction in FIG. 2. In this case, also when the pressing plate 46 moves into the banknote storage bag 34, to push banknotes on each temporary storage 44 into the banknote storage bag 34 as shown in FIG. 2, it can be detected that the pushing portion 46*a* is pushed upward by banknotes stored in the banknote storage bag 34 and the pushing portion 46*a* rotates upward about the shaft 46*c*.

In the present embodiment, the pressing plate 46 thus acts as a presser that moves into the banknote storage bag 34 held by the pair of holding members 36, and presses banknotes stored in the banknote storage bag 34 toward each stage 40. The pressing plate 46 acts also as a guide for guiding a banknote when the banknote sent by the banknote sending-out unit 48 is stored on each temporary storage 44. When each temporary storage 44 is in full state of banknotes or nearly full state of banknotes, the pushing portion 46*a* of the pressing plate 46 is pushed upward, and the to-be-detected member 46*d* is detected by the detection sensor 47. That is, when each temporary storage 44 is in full state of banknotes or nearly full state of banknotes, the detection sensor 47 detects that the temporary storage 44 is in full state of banknotes or nearly full state of banknotes.

Next, a mechanism for moving the pressing plate 46 downward and a mechanism for rotating the pair of temporary storage 44 downward in the banknote storing mechanism 32 according to the present embodiment will be described with reference to FIG. 8 and FIG. 9. In the banknote storing mechanism 32 according to the present embodiment, one motor 54 (see FIG. 9) is used to simultaneously perform an operation of moving the pressing plate 46 downward and an operation of rotating the pair of temporary storage 44 downward.

Figure 8:
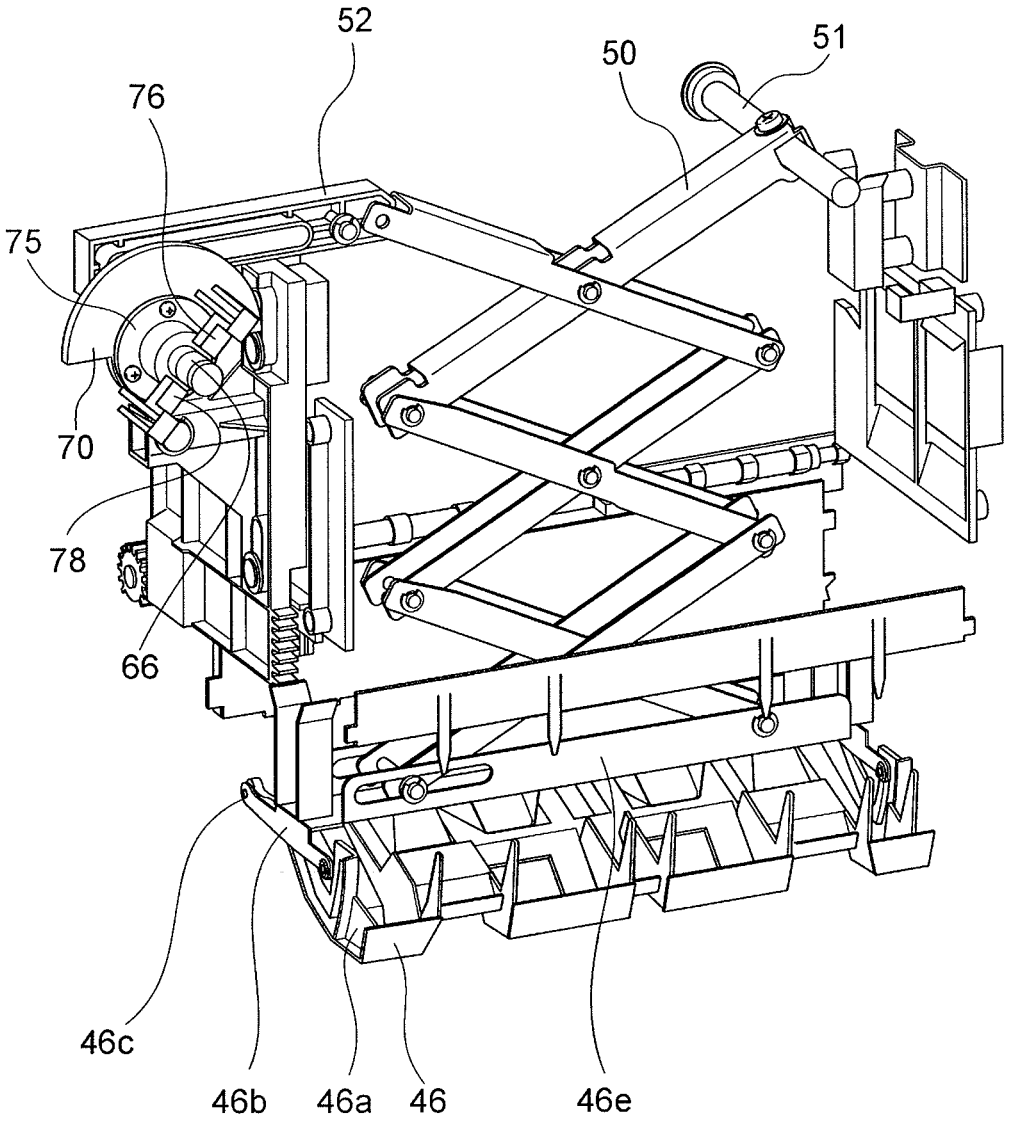

As shown in FIG. 8, a mounting member 46*e* is mounted to the upper surface of the base portion 46*b* of the pressing plate 46, and two lower end portions of the pantograph 50 are mounted to the mounting member 46*e*. One of the two lower end portions of the pantograph 50 is mounted so as to be rotatable relative to the mounting member 46*e*, whereas the other of the two lower end portions has a pin member, and the pin member is moved in the horizontal direction in a long hole formed in the mounting member 46*e*. Furthermore, one of two upper end portions of the pantograph 50 has a shaft 51 mounted thereto, and the upper end portion rotates about the shaft 51. The other of the two upper end portions of the pantograph 50 is rotatably mounted to a rack 52 that is moved in the horizontal direction by a not-illustrated pinion. When the rack 52 is moved by the pinion so as to be close to the shaft 51, the pantograph 50 extends downward, whereby the pressing plate 46 mounted to the lower end portion of the pantograph 50 is also moved downward. Meanwhile, when the rack 52 is moved by the pinion so as to be distant from the shaft 51, the pantograph 50 contracts upward, whereby the pressing plate 46 mounted to the lower end portion of the pantograph 50 is also moved upward.

Next, a configuration of the motor 54 and the like for simultaneously performing an operation of moving the pressing plate 46 downward, and an operation of rotating the pair of temporary storage 44 downward will be described with reference to FIG. 9. As shown in FIG. 9, a gear 55 is mounted to the motor 54, and both forward rotation and reverse rotation of the gear 55 are performed by the motor 54. The gear 55 mounted to the motor 54 meshes with another gear 56. The gear 56 further meshes with another gear 57. A pulley 58 over which an endless belt 60 is extended is disposed at the rotating shaft of the gear 57, and the gear 57 and the pulley 58 rotate in synchronization with each other. A torque limiter 59 is disposed at the rotating shaft of the gear 57. When an excessive torque higher than a predetermined torque is applied between the rotating shaft and the pulley 58, the rotating shaft and the pulley 58 are disconnected from each other and the rotating shaft rotates relative to the pulley 58 in an idling state. The endless belt 60 is extended also over another pulley 62. Another gear (not shown) is mounted to the rotating shaft of the pulley 62, and the pulley 62 and the gear rotate in synchronization with each other. The gear mounted to the rotating shaft of the pulley 62 meshes with another gear 64, and the gear 64 rotates about a rotating shaft 66. In such a configuration, when forward rotation and reverse rotation of the gear 55 are performed by the motor 54, the rotating shaft 66 performs forward rotation and the reverse rotation.

Figure 9:
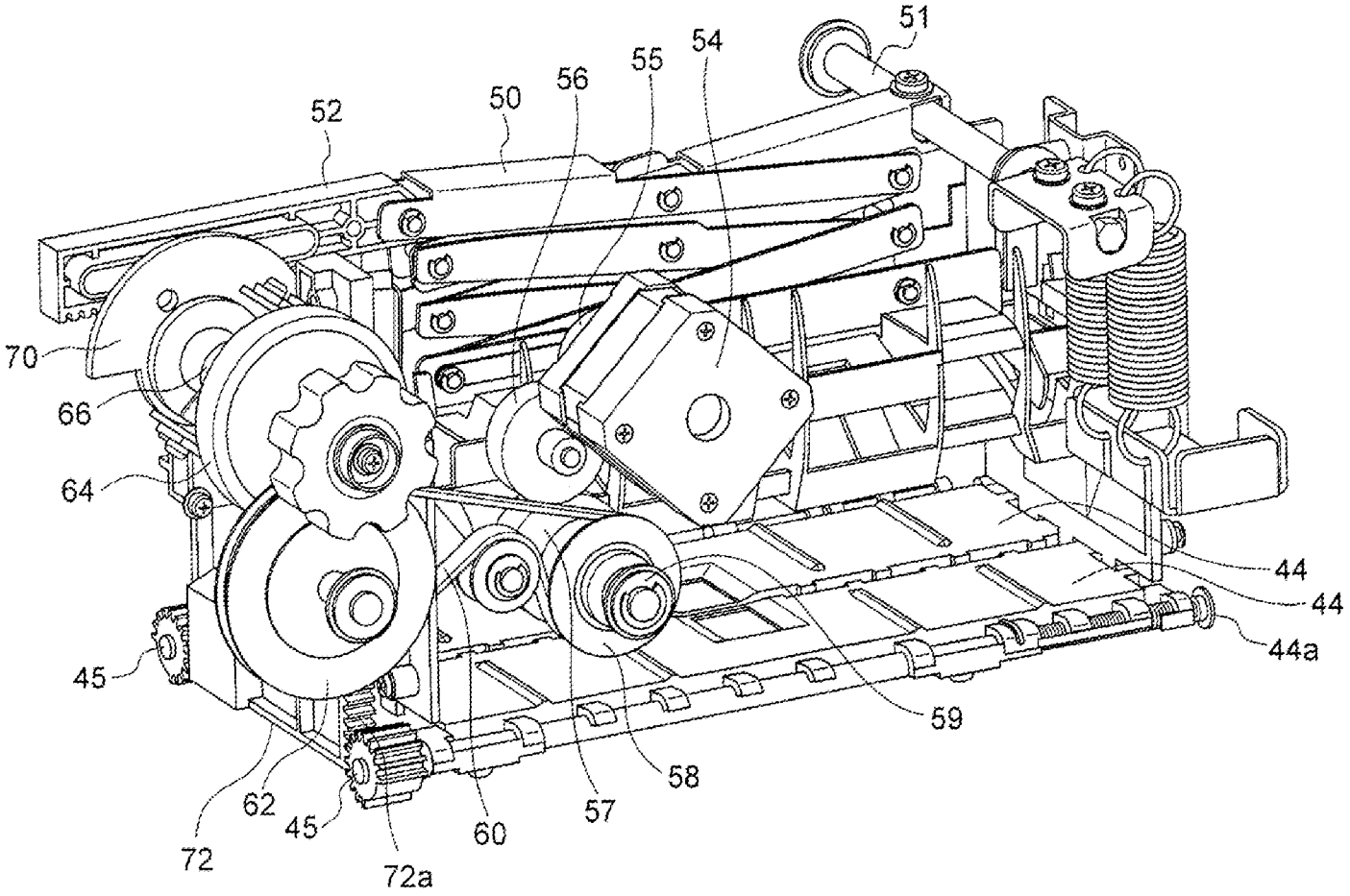

As shown in FIG. 8 and FIG. 9, the above-described pinion (not shown), a cam 70, and a to-be-detected plate 75 are mounted to the rotating shaft 66, and, when the rotating shaft 66 rotates, the pinion, the cam 70, and the to-be-detected plate 75 also rotate about the rotating shaft 66. As described above, when the pinion rotates about the rotating shaft 66, the rack 52 is moved so as to be close to the shaft 51 or distant from the shaft 51, so that the pantograph 50 extends or contracts. Near the cam 70, a power transmission member 72 for operating each temporary storage 44 is disposed. As shown in FIG. 9, the power transmission member 72 is an almost rectangular plate-like member. The power transmission member 72 is disposed so as to extend in the vertical direction. Near each of the lower end portions on both the side edges of the power transmission member 72, a teeth portion 72*a* is formed so as to linearly extend. A gear 45 is mounted to each of the shafts 44*a* of the paired temporary storage 44, and the gear 45 meshes with the teeth portion 72*a* of the power transmission member 72. Therefore, when the power transmission member 72 in the state shown in FIG. 9 moves downward, the teeth portions 72*a* rotate the gears 45, respectively, so that each temporary storage 44 opens downward about the shaft 44*a*. In a case where no force is applied to the power transmission member 72, the power transmission member 72 is drawn upward by a not-illustrated tension spring or the like. A roller is rotatably mounted to the power transmission member 72, and the outer circumferential surface of the roller is brought into contact with the outer circumferential surface of the cam 70. When the cam 70 rotates about the rotating shaft 66 in the clockwise direction in FIG. 9, the roller is pushed downward by the outer circumferential surface of the cam 70, so that the power transmission member 72 moves downward against a drawing force due to the above-described tension spring or the like. When the power transmission member 72 thus moves downward, the teeth portions 72*a* rotate the gears 45, respectively, as described above, so that each temporary storage 44 opens downward about the shaft 44*a*.

As shown in FIG. 8, near the rotating shaft 66, two sensors (specifically, an upper end detection sensor 76 and a lower end detection sensor 78) for detecting for the to-be-detected plate 75 mounted to the rotating shaft 66 are disposed. More specifically, when the pantograph 50 fully contracts, and the pressing plate 46 is at the upper end position (retracting position), the to-be-detected plate 75 is detected by the upper end detection sensor 76. When the pantograph 50 fully extends, and the pressing plate 46 is at the lower end position, the to-be-detected plate 75 is detected by the lower end detection sensor 78. Thus, the upper end detection sensor 76 and the lower end detection sensor 78 detect that the pressing plate 46 is at the upper end position (retracting position) and the lower end position, respectively.

As shown in FIG. 2, a one-side aligning lever 39 is disposed below the right side holding member 36 among the pair of holding members 36, and banknotes that are stored in the banknote storage bag 34 held by the pair of holding members 36 are aligned on one side (specifically, the left side in FIG. 2) in the banknote storage bag 34 by the one-side aligning lever 39. More specifically, the one-side aligning lever 39 in the state shown in FIG. 2 is moved leftward by a one-side aligning lever driver 39*a* (see FIG. 10) that includes a pantograph, an electric actuator, and the like.

In the banknote storing mechanism 32 of the present embodiment, a stage position detector 79 for detecting a position of each stage 40 in the vertical direction is disposed. Specifically, each stage 40 is moved in a predetermined movement range so as to be distant from each holding member 36 and be close to each holding member 36. That is, each stage 40 is moved in the predetermined movement range in the up-down direction in FIG. 2. A to-be-detected plate (not shown) is mounted to each stage 40. The stage position detector 79 has: a first sensor 79*a* for detecting the to-be-detected plate mounted to each stage 40 when the stage 40 is positioned at the lower end in the predetermined movement range; and a second sensor 79*b* disposed above the first sensor 79*a*. The second sensor 79*b* detects a position of each stage 40 when the banknote storage bag 34 held by each holding member 36 is in full state of banknotes or nearly full state of banknotes. In FIG. 11, reference character A represents a position of the upper end surface of each stage 40 in the case of the stage 40 being detected by the first sensor 79*a*, and reference character B represents a position of the upper end surface of each stage 40 in the case of the stage 40 being detected by the second sensor 79*b*.

Figure 10:
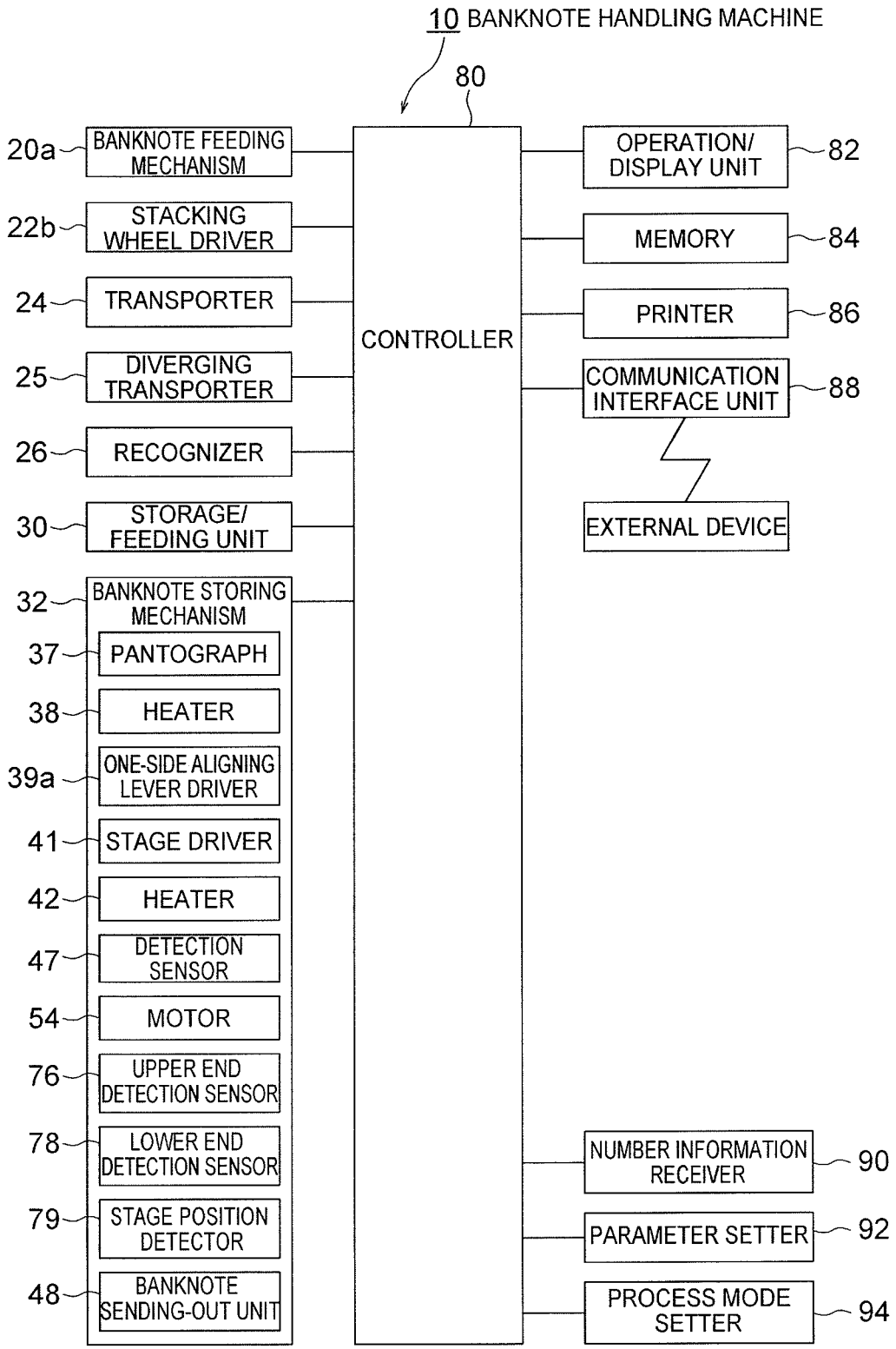

The banknote handling machine 10 of the present embodiment has a controller 80 that controls the components of the banknote handling machine 10. More specifically, as shown in FIG. 10, the banknote feeding mechanism 20*a* disposed at the inlet 20, a stacking wheel driver 22*b* for driving the stacking wheel 22*a* disposed at the outlet unit 22, the transporter 24, the diverging transporter 25, the recognizer 26, the storage/feeding unit 30, the banknote storing mechanism 32 (specifically, the pantograph 37, the heating member 38, the one-side aligning lever driver 39*a*, the stage driver 41, the heater 42, the detection sensor 47, the motor 54, the upper end detection sensor 76, the lower end detection sensor 78, the stage position detector 79, and the banknote sending-out unit 48), and the like, are connected to the controller 80. A signal representing a result of recognition of a banknote by the recognizer 26 is transmitted to the controller 80, and the controller 80 controls operations of the components by transmitting an instruction signal to each component of the banknote handling machine 10. Detection information by the detection sensor 47, the upper end detection sensor 76, the lower end detection sensor 78, and the stage position detector 79 is also transmitted to the controller 80.

As shown in FIG. 10, an operation/display unit 82, a memory 84, a printer 86, and a communication interface unit 88 are connected to the controller 80. As shown in FIG. 1, the operation/display unit 82 is implemented by, for example, a touch panel disposed on the upper surface of the housing 12, and the operation/display unit 82 displays information on, for example, a state of handling such as depositing of banknotes in the banknote handling machine 10, and an inventory amount of banknotes stored in each banknote storage bag 34. When an operator operates the operation/display unit 82, various instructions can be provided to the controller 80. The memory 84 stores information on, for example, a history of handling such as depositing of banknotes in the banknote handling machine 10, and an inventory amount of banknotes stored in each banknote storage bag 34. The printer 86 prints, on a receipt or the like, information on, for example, a history of handling such as depositing of banknotes in the banknote handling machine 10 and an inventory amount of banknotes stored in each banknote storage bag 34. The controller 80 can transmit a signal to and receive a signal from an external device (specifically, for example, higher-ranking terminal) disposed separately from the banknote handling machine 10 of the present embodiment, through the communication interface unit 88. Specifically, the controller 80 can transmit information stored in the memory 84 through the communication interface unit 88 to an external device which is disposed separately from the banknote handling machine 10. For example, when the banknotes together with the banknote storage bag 34 are collected by, for example, a guard of a cash-in-transit company, the information on the collected banknotes is transmitted to, for example, a computer of the cash-in-transit company through the communication interface unit 88.

As shown in FIG. 10, a number information receiver 90, a parameter setter 92, and a process mode setter 94 are connected to the controller 80. Functions of the number information receiver 90, the parameter setter 92, and the process mode setter 94 will be described below in detail.

Next, an operation of the banknote handling machine 10 having such a configuration will be described. The operation of the banknote handling machine 10 as described below is performed by the controller 80 controlling the components of the banknote handling machine 10.

Firstly, an operation of depositing of banknotes in the banknote handling machine 10 will be described. An operator inserts banknotes in the inlet 20 and then provides the controller 80 with an instruction for starting the depositing through the operation/display unit 82. Then, the banknotes inserted in the inlet 20 are fed out into the housing 12 one by one by the banknote feeding mechanism 20*a*, and transported one by one by the transporter 24. The recognizer 26 performs recognition of a denomination, authentication, face/back, fitness, new/old, a transport state, and the like for the banknote transported by the transporter 24. A banknote recognized as being not normal by the recognizer 26, that is, a rejected note is transported to the outlet unit 22 by the transporter 24, and stacked in the outlet unit 22. Thus, the operator is allowed to manually take out the rejected banknotes stacked in the outlet unit 22 from the front surface of the housing 12, and, for example, to insert again the banknotes in the inlet 20. Meanwhile, a banknote recognized as being normal by the recognizer 26 is transported to the storage/feeding unit 30, and temporarily stored in the storage/feeding unit 30. The number of banknotes temporarily stored in the storage/feeding unit 30 and the total monetary amount thereof are displayed for each denomination by the operation/display unit 82. When the operator confirms the displayed contents, and performs an operation of confirming the depositing, banknotes are fed out one by one from the storage/feeding unit 30 to the transporter 24, are diverted from the transporter 24 to the diverging transporter 25, are transported from the diverging transporter 25 to the banknote storage bag 34, and are stored in the banknote storage bag 34.

When the banknote storage bag 34 to which the banknote recognized by the recognizer 26 is to be transported is in full state or nearly full state, and the banknote cannot be stored in the banknote storage bag 34, the storage/feeding unit 30 may be used as a storage for storing banknotes until the full state or the nearly full state is overcome. Specifically, the banknotes recognized by the recognizer 26 are transported to the storage/feeding unit 30, and stored in the storage/feeding unit 30. The banknote storage bag 34 in the full state or the nearly full state, is taken out from the banknote storing mechanism 32 of the lower unit assembly 16 by a guard of a cash-in-transit company, a clerk of the store, or the like, and the empty banknote storage bag 34 is mounted to the banknote storing mechanism 32, and banknotes are then fed out one by one from the storage/feeding unit 30 to the transporter 24, and transported to the banknote storage bag 34 by the transporter 24.

In the present embodiment, when the banknote recognized by the recognizer 26 is stored in the banknote storage bag 34, information on the number of banknotes stored in the banknote storage bag 34 is received by the number information receiver 90 based on the recognition result by the recognizer 26. Thus, the controller 80 can obtain the number of banknotes stored in the banknote storage bag 34 based on the information received by the number information receiver 90.

Next, an operation of storing a banknote transported from the diverging transporter 25 of the upper unit assembly 14 to the lower unit assembly 16, in the banknote storage bag 34 held by the pair of holding members 36, in the banknote storing mechanism 32, will be described.

The banknote transported from the diverging transporter 25 of the upper unit assembly 14 to the lower unit assembly 16 is sent onto the pair of left and right temporary storage 44 by the banknote sending-out unit 48, and stacked on the temporary storage 44. When a predetermined number of banknotes are stacked on each temporary storage 44, the temporary storage 44 rotates about the shaft 44*a* disposed at the proximal end portion in the downward direction (that is, the directions indicated by the arrows in FIG. 2), and the banknotes stacked on each temporary storage 44 fall from the temporary storage 44 due to its own weight, and are stored in the banknote storage bag 34. Specifically, the motor 54 rotates the gear 55, to rotate the rotating shaft 66, and the cam 70 mounted to the rotating shaft 66 rotates, whereby the power transmission member 72 moves downward. When the power transmission member 72 moves downward, each gear 45 is rotated by the teeth portion 72*a* disposed at the power transmission member 72, so that each temporary storage 44 opens downward about the shaft 44*a*. When the motor 54 rotates the gear 55 to rotate the rotating shaft 66, the pinion rotates, and the rack 52 is moved by the pinion so as to be close to the shaft 51. Thus, the pantograph 50 extends downward, and the pressing plate 46 mounted to the lower end portion of the pantograph 50 is also moved downward. Thus, when the banknotes temporarily stored on each temporary storage 44 are stored in the banknote storage bag 34, banknotes having been left in each temporary storage 44 can be pushed toward the banknote storage bag 34 by the pressing plate 46.

When banknotes fall from each temporary storage 44, and are stored in the banknote storage bag 34, each stage 40 is moved downward by the stage driver 41, and a space for subsequently storing banknotes sent to the banknote storage bag 34 from each temporary storage 44 is formed in the banknote storage bag 34. More specifically, in a state where the banknotes stored in the banknote storage bag 34 are pressed toward each stage 40 by the pressing plate 46, each stage 40 and the pressing plate 46 integrally move in the downward direction in FIG. 2. At this time, in a case where the pressing plate 46 is moved into the banknote storage bag 34, and the banknotes stored in the banknote storage bag 34 are brought into contact with the pressing plate 46, when the lower end detection sensor 78 does not detect that the pressing plate 46 is at the lower end position, each stage 40 is moved downward. Thus, in a state where banknotes are gripped between each stage 40 and the pressing plate 46, each stage 40 is moved downward by the stage driver 41. Extending of the pantograph 50 causes the pressing plate 46 to be also moved downward. The torque limiter 59 is disposed at the rotating shaft of the gear 57. When an excessive torque higher than a predetermined torque is applied between the rotating shaft and the pulley 58, the rotating shaft and the pulley 58 are disconnected from each other, and the rotating shaft rotates relative to the pulley 58 in an idling state. Therefore, excessive pressing force is not applied to banknotes by the pressing plate 46. Thereafter, in a case where the pressing plate 46 reaches the lower end position, and the lower end detection sensor 78 detects that the pressing plate 46 is at the lower end position, each stage 40 is stopped. Thus, when each stage 40 is moved downward, since the banknotes are pushed toward the stage 40 in the banknote storage bag 34 by the pressing plate 46 until the pressing plate 46 reaches the lower end position, banknotes stacked in the banknote storage bag 34 in a layered state are compressed in the stacking direction, so that collapsing of the banknotes stored in the banknote storage bag 34 in the layered state can be inhibited. After each stage 40 has been stopped, the pressing plate 46 retracts upward from the banknote storage bag 34. At this time, in a case where banknotes stored in the banknote storage bag 34 are, for example, wrinkled banknotes, when the pressing plate 46 retracts upward from the banknote storage bag 34, a plurality of banknotes stored in the banknote storage bag 34 is released from the compressed state by the pressing plate 46, and may expand in the layering direction. Meanwhile, in a case where banknotes stored in the banknote storage bag 34 are, for example, brand-new notes, even when the pressing plate 46 retracts upward from the banknote storage bag 34, a plurality of banknotes stored in the banknote storage bag 34 does not greatly expand in the layering direction.

When each stage 40 is moved downward and the second sensor 79*b* detects the stage 40 (that is, when the upper surface of the stage 40 reaches a position represented by reference character B in FIG. 11), the banknote storage bag 34 is determined as being in full state of banknotes or nearly full state of banknotes. In this case, after the pressing plate 46 retracts upward from the banknote storage bag 34, the opening of the banknote storage bag 34 is heat-sealed by each heating member 38. More specifically, in a case where the lower end detection sensor 78 detects that the pressing plate 46 is at the lower end position, each stage 40 is temporarily stopped. However, in a case where banknotes are stored in the banknote storage bag 34, when, while each stage 40 is moving downward, the stage 40 is detected by the second sensor 79*b*, after the pressing plate 46 has retracted upward from the banknote storage bag 34, the stage driver 41 moves the stage 40 to the lower end in the predetermined movement range. That is, each stage 40 is moved downward until the stage 40 is detected by the first sensor 79*a*. Thus, a region, near the opening of the banknote storage bag 34, which is to be heat-sealed by each heating member 38 can be assured. In other words, after the banknote storage bag 34 is determined as being in full state of banknotes or nearly full state of banknotes, unless each stage 40 is moved downward, when the opening of the banknote storage bag 34 is heat-sealed by each heating member 38, the banknote in the banknote storage bag 34 contacts with the heating member 38, whereby the poor sealing may occur. Therefore, after each stage 40 is detected by the second sensor 79*b*, the stage 40 is further moved downward.

Figure 11A:
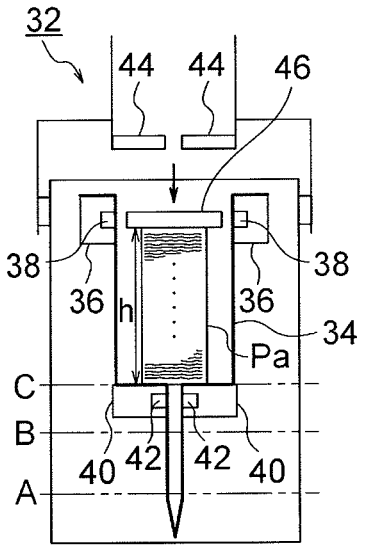
Figure 11B:
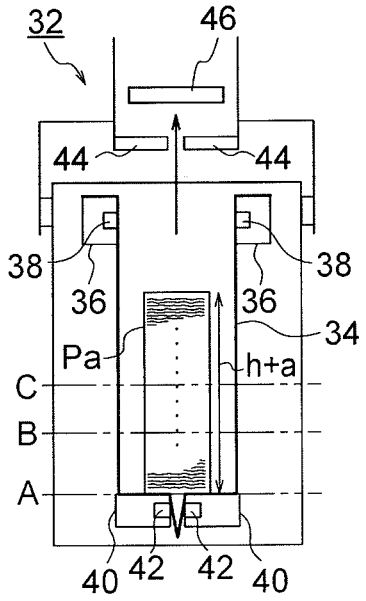
Figure 11C:
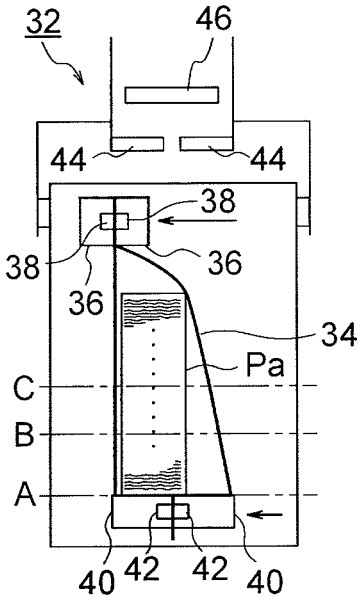
Figure 11D:
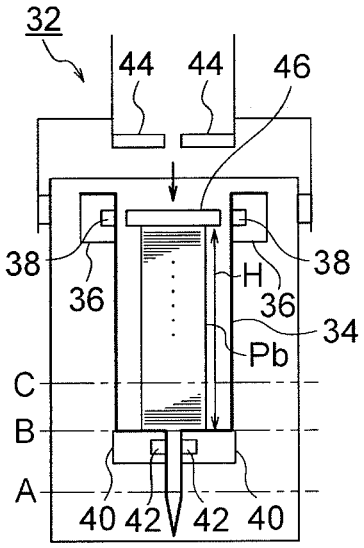
Figure 11E:
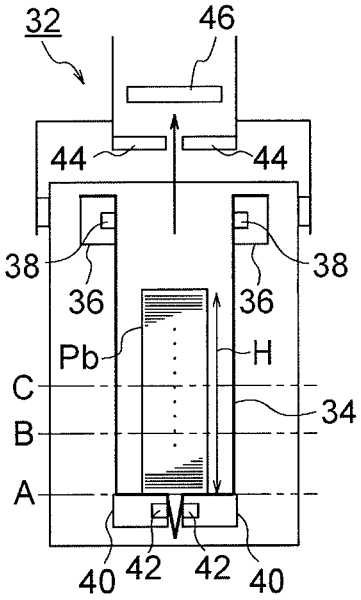

In the present embodiment, in a case where banknotes temporarily stored on each temporary storage 44 are stored in the banknote storage bag 34 held by each holding member 36, when a distance between each stage 40 and the pressing plate 46 that is pressing the banknotes stored in the banknote storage bag 34 toward the stage 40 is greater than a predetermined distance h, the controller 80 stops the operation of storing a banknote in the banknote storage bag 34 on the condition that the number of banknotes received by the number information receiver 90 is less than a predetermined number m. The predetermined distance h and the predetermined number m are preset values. Specifically, in a case where banknotes stored in the banknote storage bag 34 are wrinkled banknotes, the banknote storage bag 34 is determined as being in full state of banknotes or nearly full state of banknotes before each stage 40 is detected by the second sensor 79*b*, and the stage 40 is moved to a position (that is, the position of the lower end in the predetermined movement range) detected by the first sensor 79*a*. Such an operation will be described with reference to FIG. 11A to FIG. 11E. FIG. 11A to FIG. 11C are side views sequentially showing operations of storing wrinkled banknotes (represented by reference character Pa) in the banknote storage bag 34. FIG. 11D and FIG. 11E are side views sequentially showing operations of storing banknotes (represented by reference character Pb) as brand-new notes in the banknote storage bag 34.

Firstly, an operation of storing wrinkled banknotes in the banknote storage bag 34 will be described with reference to FIG. 11A to FIG. 11C. In a case where banknotes stored in the banknote storage bag 34 are not brand-new notes but wrinkled banknotes, when the banknotes are pushed toward each stage 40 in the banknote storage bag 34 by the pressing plate 46, and the pressing plate 46 thereafter retracts upward from the banknote storage bag 34, a plurality of banknotes stored in the banknote storage bag 34 may expand in the layering direction. In this case, if the banknote storage bag 34 is determined as being in full state of banknotes or nearly full state of banknotes since each stage 40 reaches the position represented by reference character B, and the stage 40 is thereafter moved from the position represented by reference character B to the position represented by reference character A, a region, near the opening of the banknote storage bag 34, which is to be heat-sealed by each heating member 38 may not be sufficiently assured. That is, if each stage 40 is merely moved from the position represented by reference character B to the position represented by reference character A, when the pressing plate 46 retracts upward from the banknote storage bag 34, a plurality of banknotes stored in the banknote storage bag 34 expands in the layering direction, and, therefore, the banknote in the banknote storage bag 34 contacts with the heating member 38 when the opening of the banknote storage bag 34 is heat-sealed by each heating member 38, so that poor sealing may occur. Therefore, a distance over which each stage 40 is moved needs to be increased in order to sufficiently assure a region, near the opening of the banknote storage bag 34, which is to be heat-sealed by each heating member 38.

Therefore, in the present embodiment, in a case where banknotes temporarily stored on each temporary storage 44 are stored in the banknote storage bag 34 held by each holding member 36, when a distance between each stage 40 and the pressing plate 46 that is pressing the banknotes stored in the banknote storage bag 34 toward the stage 40 is greater than the predetermined distance h, if the number of banknotes received by the number information receiver 90 is less than the predetermined number m, the banknote storage bag 34 is determined as being in full state of banknotes or nearly full state of banknotes. More specifically, as shown in FIG. 11A, in a case where each stage 40 is slightly moved downward as a banknote is stored in the banknote storage bag 34, and the upper surface of the stage 40 reaches the position (position higher than the position represented by reference character B) represented by reference character C in FIG. 11, or reaches a position lower than the position represented by reference character C, the controller 80 determines whether or not the number of banknotes received by the number information receiver 90 is greater than or equal to the predetermined number m. More specifically, as described above, when banknotes are stored in the banknote storage bag 34, each stage 40 is moved downward, and the banknotes are pushed toward the stage 40 in the banknote storage bag 34 by the pressing plate 46 until the pressing plate 46 reaches the lower end position, and, when the pressing plate 46 reaches the lower end position, the stage 40 is stopped. In a case where, when the stage 40 is stopped, the upper surface of the stage 40 is at the position represented by reference character C in FIG. 11, or at a position lower than the position represented by reference character C, the controller 80 determines whether or not the number of banknotes received by the number information receiver 90 is greater than or equal to the predetermined number m. FIG. 11A illustrates a state where the pressing plate 46 is at the lower end position. As shown in FIG. 11A, a distance between the lower end surface of the pressing plate 46 that is at the lower end position and the position represented by reference character C is set as the predetermined distance h. That is, the position represented by reference character C is lower than the lower end surface of the pressing plate 46 that is at the lower end position, by the predetermined distance h.

In a case where the upper surface of the stage 40 is at the position represented by reference character C in FIG. 11 or at a position lower than the position represented by reference character C, when the number of banknotes received by the number information receiver 90 is greater than or equal to the predetermined number m, banknotes stored in the banknote storage bag 34 are determined as brand-new notes, and an operation of storing a banknote in the banknote storage bag 34 is not stopped. Such an operation will be described below. Meanwhile, as shown in FIG. 11A, in a case where the upper surface of the stage 40 is at the position represented by reference character C in FIG. 11 or at a position lower than the position represented by reference character C, when the number of banknotes received by the number information receiver 90 is less than the predetermined number m, banknotes stored in the banknote storage bag 34 are determined as wrinkled banknotes, and an operation of transporting a banknote from the transporter 24 through the diverging transporter 25 and the banknote sending-out unit 48 to the temporary storage 44 is stopped. In this case, as shown in FIG. 11B, the pressing plate 46 retracts upward from the banknote storage bag 34, and the pressing plate 46 is disposed at the upper end position (retracted position). Due to this, a plurality of banknotes stored in the banknote storage bag 34 may expand in the layering direction. In FIG. 11B, reference character a represents an amount of expansion of the plurality of banknotes in the layering direction. Thus, when the plurality of banknotes stored in the banknote storage bag 34 expands in the layering direction, the height of the plurality of banknotes has a magnitude of h+a. Furthermore, each stage 40 is moved downward to the lower end position (that is, the position detected by the first sensor 79*a*) in the predetermined movement range by the stage driver 41. Since each stage 40 is moved downward from the position represented by reference character C to the position represented by reference character A in FIG. 11, a region, near the opening of the banknote storage bag 34, which is to be heat-sealed by each heating member 38, can be widened as compared to a case where each stage 40 is moved downward from the position represented by reference character B to the position represented by reference character A in FIG. 11. That is, in a case where banknotes stored in the banknote storage bag 34 are wrinkled banknotes, when the pressing plate 46 retracts upward from the banknote storage bag 34, if a plurality of banknotes stored in the banknote storage bag 34 expands in the layering direction, an operation of storing a banknote in the banknote storage bag 34 is stopped, and a distance over which each stage 40 is moved downward is then increased, whereby a region, near the opening of the banknote storage bag 34, which is to be heat-sealed by each heating member 38, can be sufficiently assured.

Thereafter, as shown in FIG. 11C, one of the holding members 36 is moved so as to be close to the other of the holding members 36, whereby a portion, near the opening, of the banknote storage bag 34 is gripped by the holding members 36. Specifically, the right side holding member 36 is moved so as to be close to the left side holding member 36 in FIG. 11. Thereafter, the opening of the banknote storage bag 34 is heat-sealed by each heating member 38. Furthermore, one of the stages 40 is moved so as to be close to the other of the stages 40, whereby a portion, near the bottom, of the banknote storage bag 34 is gripped by the stages 40. A portion, of the banknote storage bag 34, which serves as the bottom thereof when banknotes are stored in the banknote storage bag 34 is heat-sealed by each heater 42. Thereafter, the holding members 36 are moved so as to be separate from each other. Specifically, the right side holding member 36 is moved so as to be distant from the left side holding member 36 in FIG. 11. Furthermore, the stages 40 are moved so as to be separate from each other. Thereafter, the banknote storage bag 34 is dismounted from each holding member 36, whereby the banknote storage bag 34 can be taken out through the upper side of each holding member 36 of the banknote storing mechanism 32 in the upward direction.

Meanwhile, in a case where the upper surface of the stage 40 is at the position represented by reference character C in FIG. 11 or at a position lower than the position represented by reference character C, when the number of banknotes received by the number information receiver 90 is greater than or equal to the predetermined number m, banknotes stored in the banknote storage bag 34 are determined as brand-new notes, and an operation of transporting a banknote from the transporter 24 through the diverging transporter 25 and the banknote sending-out unit 48 to the temporary storage 44 is not stopped. In this case, an operation of storing banknotes in the banknote storage bag 34 is continued until each stage 40 is detected by the second sensor 79*b*. As shown in FIG. 11D, when each stage 40 is detected by the second sensor 79*b*, the banknote storage bag 34 is determined as being in full state of banknotes or nearly full state of banknotes, an operation of transporting a banknote from the transporter 24 through the diverging transporter 25 and the banknote sending-out unit 48 to the temporary storage 44 is stopped. Reference character H represents a height of a plurality of banknotes in the layering direction in the case of the operation of transporting a banknote to the temporary storage 44 being stopped. Thereafter, as shown in FIG. 11E, the pressing plate 46 retracts upward from the banknote storage bag 34, and the pressing plate 46 is disposed at the upper end position (retracted position). In a case where banknotes stored in the banknote storage bag 34 are brand-new notes, even when the pressing plate 46 retracts upward from the banknote storage bag 34, a plurality of banknotes stored in the banknote storage bag 34 does not greatly expand in the layering direction. That is, the height of the plurality of banknotes stored in the banknote storage bag 34 remains as represented by reference character H. Thereafter, each stage 40 is moved downward to the lower end position (that is, position detected by the first sensor 79*a*) in the predetermined movement range by the stage driver 41. In this case, each stage 40 is moved downward from the position represented by reference character B to the position represented by reference character A in FIG. 11 in order to assure a region, near the opening of the banknote storage bag 34, which is to be heat-sealed by each heating member 38, whereby a distance over which the stage 40 is moved is reduced as compared to the manner shown in FIG. 11A to FIG. 11C. However, in a case where a plurality of banknotes stored in the banknote storage bag 34 is brand-new notes, the banknotes may not greatly expand in the layering direction. Therefore, poor sealing is inhibited from occurring. Furthermore, in the manner shown in FIG. 11D and FIG. 11E, banknotes can be stored in the banknote storage bag 34 while each stage 40 is moved downward from the position represented by reference character C to the position represented by reference character B, whereby the number of banknotes to be stored in the banknote storage bag 34 can be increased.

A relationship between the predetermined distance h and the predetermined number m in the above-described operation will be described. In a case where banknotes to be stored in the banknote storage bag 34 are wrinkled banknotes, a height per one banknote is increased when the banknotes are pushed toward each stage 40 by the pressing plate 46. That is, a value, obtained by dividing the height of banknotes stored in the banknote storage bag 34 when each stage 40 is moved downward while the banknotes are gripped between the pressing plate 46 and the stage 40, by the number (that is, the number of banknotes received by the number information receiver 90) of the banknotes stored in the banknote storage bag 34, is increased. Therefore, when the upper surface of the stage 40 is at the position represented by reference character C in FIG. 11 or at a position lower than the position represented by reference character C, and a distance between the lower end surface of the pressing plate 46 and the upper surface of each stage 40 is greater than the predetermined distance h, the number of banknotes stored in the banknote storage bag 34 is less than the predetermined number m. Meanwhile, when banknotes stored in the banknote storage bag 34 are brand-new notes, a height per one banknote is reduced when the banknotes are pushed toward each stage 40 by the pressing plate 46. That is, a value, obtained by dividing the height of banknotes stored in the banknote storage bag 34 when each stage 40 is moved downward while the banknotes are gripped between the pressing plate 46 and the stage 40, by the number (that is, the number of banknotes received by the number information receiver 90) of the banknotes stored in the banknote storage bag 34, is reduced. Therefore, when the upper surface of the stage 40 is at the position represented by reference character C in FIG. 11 or at a position lower than the position represented by reference character C, and a distance between the lower end surface of the pressing plate 46 and the upper surface of each stage 40 is greater than the predetermined distance h, the number of banknotes stored in the banknote storage bag 34 is greater than the predetermined number m. Thus, a value obtained by dividing a distance between the lower end surface of the pressing plate 46 and the upper surface of each stage 40 in the case of the stage 40 being moved downward while banknotes are gripped between the pressing plate 46 and the stage 40, by the number of banknotes stored in the banknote storage bag 34 is different between a case where banknotes stored in the banknote storage bag 34 are wrinkled banknotes and a case where banknotes stored in the banknote storage bag 34 are brand-new notes.

In the present embodiment, an operator is allowed to change the value of the predetermined distance h or the predetermined number m according to a country or a region where the banknote handling machine 10 is installed. Specifically, an operator is allowed to set or change a value of the predetermined distance h by using the operation/display unit 82. The parameter setter 92 sets the value of the predetermined distance h based on the information inputted through the operation/display unit 82. Furthermore, an operator is allowed to set or change a value of the predetermined number m by using the operation/display unit 82. The parameter setter 92 sets the value of the predetermined number m based on the information inputted through the operation/display unit 82. Thus, the parameter setter 92 can set the predetermined distance h and the predetermined number m. In a banknote handling machine according to modification, the parameter setter 92 may set one of the predetermined distance h or the predetermined number m. In this case, although a parameter of one of the predetermined distance h or the predetermined number m can be changed, a parameter of the other thereof cannot be changed.

In the present embodiment, as a process mode for an operation of storing banknotes in the banknote storage bag 34, one of a first process mode or a second process mode may be selected. An operator is allowed to perform such selection of the process mode by using the operation/display unit 82. The process mode setter 94 sets one of the first process mode or the second process mode as the process mode for the operation of storing banknotes in the banknote storage bag 34, based on the information inputted by the operator by using the operation/display unit 82. In a case where the first process mode is selected by the process mode setter 94, and banknotes are stored in the banknote storage bag 34 held by each holding member 36, when a distance between each stage 40 and the pressing plate 46 that is pressing the banknotes stored in the banknote storage bag 34 toward the stage 40 is greater than the predetermined distance h, the controller 80 stops the operation of storing a banknote in the banknote storage bag 34 on the condition that the number of banknotes received by the number information receiver 90 is less than the predetermined number m, as described above. Meanwhile, in a case where the second process mode is selected by the process mode setter 94, and banknotes are stored in the banknote storage bag 34 held by each holding member 36, when a distance between each stage 40 and the pressing plate 46 that is pressing the banknotes stored in the banknote storage bag 34 toward the stage 40 is greater than the predetermined distance h, even if the number of banknotes received by the number information receiver 90 is less than the predetermined number m, an operation of storing a banknote in the banknote storage bag 34 is not stopped. That is, also in a case where, when the upper surface of the stage 40 is at the position represented by reference character C in FIG. 11 or at a position lower than the position represented by reference character C, the number of banknotes received by the number information receiver 90 is less than the predetermined number m, an operation of transporting a banknote from the transporter 24 through the diverging transporter 25 and the banknote sending-out unit 48 to the temporary storage 44 is not stopped. In this case, an operation of storing banknotes in the banknote storage bag 34 is continued until each stage 40 is detected by the second sensor 79*b*. When each stage 40 is detected by the second sensor 79*b*, the banknote storage bag 34 is determined as being in full state of banknotes or nearly full state of banknotes, and an operation of transporting a banknote from the transporter 24 through the diverging transporter 25 and the banknote sending-out unit 48 to the temporary storage 44 is stopped. Thereafter, each stage 40 is moved downward to the lower end position (that is, position detected by the first sensor 79*a*) in the predetermined movement range by the stage driver 41, and the opening of the banknote storage bag 34 is heat-sealed by each heating member 38. In a case where it is previously known that banknotes to be stored in the banknote storage bag 34 are brand-new notes, the process mode for the banknotes is set as the second process mode by the process mode setter 94, whereby forced stopping of an operation of storing a banknote in the banknote storage bag 34 when the upper surface of the stage 40 is at the position represented by reference character C in FIG. 11 or at a position lower than the position represented by reference character C can be prevented. Therefore, the number of banknotes to be stored in the banknote storage bag 34 can be increased.

In the banknote handling machine 10, according to the present embodiment, having the above-described configuration, when a distance between each stage 40 (receiver) and the pressing plate 46 (presser) that is pressing banknotes stored in the banknote storage bag 34 held (supported) by each holding member 36 (support), toward the stage 40, is greater than the predetermined distance h, the controller 80 stops an operation of storing a banknote in the banknote storage bag 34 on the condition that the number of banknotes received by the number information receiver 90 is less than the predetermined number m. Thus, also when wrinkled banknotes are stored in the banknote storage bag 34, a region, near the opening of the banknote storage bag 34, which is to be heat-sealed by each heating member 38, can be sufficiently assured. Therefore, when the opening of the banknote storage bag 34 is sealed, poor sealing due to a banknote in the banknote storage bag 34 contacting with the heating member 38 can be prevented.

More specifically, in a typical banknote handling machine, in a case where banknotes stored in a storage bag are not brand-new notes but wrinkled banknotes, after the banknotes are pushed by a pressing plate, when the pressing plate retracts outward from the banknote storage bag, a plurality of banknotes stored in the banknote storage bag may expand in the layering direction. In a conventional banknote handling machine, when a stage reaches a predetermined position, a banknote storage bag is determined as being in full state of banknotes or nearly full state of banknotes, and the opening of the banknote storage bag is heat-sealed by a heating member. However, in a case where banknotes stored in the banknote storage bag are not brand-new notes but wrinkled banknotes, when the pressing plate retracts outward from the banknote storage bag, if a plurality of banknotes stored in the banknote storage bag expands in the layering direction, poor sealing due to the banknote in the banknote storage bag contacting with the heating member may occur in the case of the opening of the banknote storage bag being heat-sealed by the heating member. Such poor sealing causes generation of a part, of the opening of the banknote storage bag, which is not sealed. Therefore, a problem arises that a banknote is extracted from the banknote storage bag through the unsealed portion. Meanwhile, according to the present embodiment, the banknote storage bag 34 is not always determined as being in full state of banknotes or nearly full state of banknotes when each stage 40 reaches a predetermined position. In a case where a distance between each stage 40 and the pressing plate 46 that is pressing banknotes stored in the banknote storage bag 34 toward the stage 40 is greater than the predetermined distance h, even when the number of banknotes received by the number information receiver 90 is less than the predetermined number m, the banknote storage bag 34 is determined as being in full state of banknotes or nearly full state of banknotes. Thus, a region, near the opening of the banknote storage bag 34, which is to be heat-sealed by each heating member 38, can be sufficiently assured. Therefore, poor sealing due to the banknote in the banknote storage bag 34 contacting with the heating member 38 can be prevented when the opening of the banknote storage bag 34 is sealed.

Furthermore, in the banknote handling machine 10 according to the present embodiment, as described above, the pair of temporary storage 44 that temporarily store banknotes to be stored in the banknote storage bag 34 is disposed, and, when a distance between each stage 40 and the pressing plate 46 that is pressing banknotes stored in the banknote storage bag 34 that is held by each holding member 36 toward the stage 40 is greater than the predetermined distance h, if the number of banknotes received by the number information receiver 90 is less than the predetermined number m, the controller 80 controls the transporter 24, the diverging transporter 25, the banknote sending-out unit 48, and the like so as not to transport a banknote to each temporary storage 44 (the transporter 24, the diverging transporter 25, and the banknote sending-out unit 48 function as a banknote sender for sending a banknote to each temporary storage 44). The banknote handling machine according to the present invention may not include a temporary storage for temporarily storing a banknote to be stored in a banknote storage bag. In the banknote handling machine according to modification, a temporary storage for temporarily storing a banknote to be stored in a banknote storage bag may not be disposed, and a banknote may be sent directly to a banknote storage bag from a banknote sending-out unit. In the banknote handling machine according to modification, when a distance between each stage and the pressing plate that is pressing banknotes stored in a banknote storage bag held by each holding member toward the stage is greater than a predetermined distance, if the number of banknotes received by the number information receiver is less than a predetermined number, the controller controls the transporter, the banknote sending-out unit, and the like so as not to send a banknote from the banknote sending-out unit to the banknote storage bag.

In the banknote handling machine 10 according to the present embodiment, as described above, in a case where a distance between each stage 40 and the pressing plate 46 that is pressing banknotes stored in the banknote storage bag 34 held by each holding member 36 toward the stage 40 is greater than the predetermined distance h, the controller 80 controls the stage driver 41 such that the stage 40 is moved so as to be distant from the holding member 36 on the condition that the number of banknotes received by the number information receiver 90 is less than the predetermined number m. Specifically, each stage 40 is moved to the position represented by reference character A in FIG. 11 (see FIG. 11B). Thus, a region, near the opening of the banknote storage bag 34, which is to be heat-sealed by each heating member 38, can be sufficiently assured.

Each stage 40 is moved so as to be distant from each holding member 36 and so as to be close to each holding member 36 (that is, in the up-down direction in FIG. 2) in a predetermined movement range. In a case where banknotes are stored in the banknote storage bag 34 held by each holding member 36, when a distance between each stage 40 and the pressing plate 46 that is pressing banknotes toward the stage 40 is greater than the predetermined distance h, if the number of banknotes received by the number information receiver 90 is greater than the predetermined number m, each stage 40 is moved to the farthest position from each holding member 36 in the predetermined movement range in the case of the stage 40 having reached a position (first predetermined position) detected by the second sensor 79*b*.

In the banknote handling machine 10 according to the present embodiment, as described above, the controller 80 controls the stage driver 41 such that, when banknotes stored in the banknote storage bag 34 held by each holding member 36 are pressed toward each stage 40 by the pressing plate 46, the stage 40 is moved so as to be distant from each holding member 36 in a state where the banknotes are gripped between the pressing plate 46 and the stage 40 until the pressing plate 46 reaches the lower end position (second predetermined position). The lower end detection sensor 78 is disposed as a detector for detecting whether or not the pressing plate 46 is at the lower end position. The controller 80 controls the stage driver 41 such that, in a case where the pressing plate 46 is moved into the banknote storage bag 34 and contacts with banknotes stored in the banknote storage bag 34, when the lower end detection sensor 78 does not detect that the pressing plate 46 is at the lower end position, each stage 40 is moved so as to be distant from the holding member 36.

In the banknote handling machine 10 according to the present embodiment, as described above, the recognizer 26 for performing recognition of a banknote to be stored in the banknote storage bag 34 is disposed, and the number of banknotes transported to the banknote storage bag 34 is calculated based on the recognition result by the recognizer 26, and the information on the calculated number of banknotes is received by the number information receiver 90. However, the banknote handling machine of the present invention is not limited to this aspect. In the banknote handling machine according to modification, the number information receiver may receive information on the number of banknotes stored in a banknote storage bag, based on information (for example, the number of banknotes inputted by an operator through the operation/display unit) other than the recognition result by the recognizer.

In the banknote handling machine 10 according to the present embodiment, as described above, the parameter setter 92 sets at least one of the predetermined distance h and the predetermined number m. The parameter setter 92 thus allows at least one of values of the predetermined distance h and the predetermined number m to be changed. Furthermore, the process mode setter 94 sets one of the first process mode or the second process mode, as a process mode for the operation of storing a banknote in the banknote storage bag 34 held by each holding member 36.

The banknote handling machine 10 and the banknote handling method according to the present embodiment are not limited to the above described aspects, and various modifications can be made.

For example, in a banknote handling machine according to modification, a tubular storage bag having an opening in each of the upper portion and the lower portion may be supported by a support, and banknotes may be stored in the storage bag supported by the support. Also in this case, the principle of the present invention can be applied to the banknote handling machine according to the modification.

According to another aspect of the present embodiment, instead of the opening of the storage bag being heat-sealed by the heating member, the opening of the storage bag may be sealed through adhesion by an adhesive. Specifically, a banknote storage bag having an adhesive in an opening in the inner surface may be used as a banknote storage bag for storing banknotes. In this case, the opening of the banknote storage bag is sealed through adhesion by an adhesive at the opening of the banknote storage bag. Also in this case, the principle of the present invention can be applied to the banknote handling machine according to the modification.

According to still another aspect of the present embodiment, the heating member for heat-sealing an opening of a banknote storage bag may be a member separate from each holding member for holding a portion, near the opening, of the banknote storage bag. Furthermore, the heating member for heat-sealing a portion, of a banknote storage bag, which serves as the bottom thereof when banknotes are stored in the banknote storage bag may be a member separate from each stage. Furthermore, a portion, of a banknote storage bag, which serves as the bottom thereof when banknotes are stored in the banknote storage bag, may not be sealed. In this case, a heating member is not disposed in each stage or the like.

Furthermore, as the sheet handling apparatus and the sheet handling method according to the present invention, an apparatus and a method for storing sheets (for example, checks or gift coupons) other than banknotes in a storage bag, may be used.

What is claimed is:

1. A sheet handling apparatus for storing sheets in a storage bag having an opening, the sheet handling apparatus comprising:

an inlet though which sheets are fed into the apparatus from outside;

a transport unit configured to transport the sheets fed into the apparatus;

a holding unit configured to hold a portion, near the opening, of the storage bag;

a stage on which a part of the storage bag held by the holding unit is placed, the stage being configured to be movable in a vertical direction;

a pressing member configured to move into the storage bag held by the holding unit between an upper position and a lower position in the vertical direction, and press the sheets stored in the storage bag toward the stage;

a recognition unit configured to recognize the sheets transported by the transport unit;

a number information receiving unit configured to receive first information on the number of sheets stored in the storage bag based on the recognition result by the recognition unit;

an operation unit through which second information is inputted;

a setting unit configured to set a predetermined distance and a predetermined number based on the second information inputted through the operation unit; and a controller configured to control the pressing member and the stage, wherein:

the controller is configured to compare the number of sheets of the first information received by the number information receiving unit with the predetermined number set by the setting unit, and the controller stops an operation of storing sheets in the storage bag on a condition that the number of sheets of the first information received by the number information receiving unit is less than the predetermined number set by the setting unit, when a distance between the stage and the pressing member pressing the sheets stored in the storage bag toward the stage is greater than the predetermined distance set by the setting unit.

2. The sheet handling apparatus according to claim 1, further comprising:

a temporary storage unit configured to temporarily store the sheets transported by the transport unit;

wherein a sheet temporarily stored in the temporary storage unit and released from the temporary storage unit is stored in the storage bag held by the holding unit, and the controller controls the transport unit such that, in a case where a distance between the stage and the pressing member that is pressing sheets stored in the storage bag held by the holding unit, toward the stage, is greater than the predetermined distance, no sheet is transported to the temporary storage unit, on the condition that the number of the sheets of the first information received by the number information receiving unit is less than the predetermined number set by the setting unit.

3. The sheet handling apparatus according to claim 1, wherein the controller controls the stage such that the stage is moved so as to be distant from the holding unit in a state where sheets are gripped between the pressing member and the stage until the pressing member reaches a second predetermined position when the sheets stored in the storage bag held by the holding unit are pressed toward the stage by the pressing member.

4. The sheet handling apparatus according to claim 3, wherein the pressing member is moved between a retracting position that is upward of the storage bag held by the holding unit and a lower end position in the storage bag, held by the holding unit, into which the pressing member is moved, and the second predetermined position is the lower end position.

5. The sheet handling apparatus according to claim 4, further comprising a pressing member detection unit for detecting whether or not the pressing member is at the lower end position, the pressing member detection unit having a lower end detection sensor configured to detect a first to-be-detected member mounted to the pressing member.

6. The sheet handling apparatus according to claim 5, wherein the controller controls the stage such that the stage is moved so as to be distant from the holding unit when the pressing member detection unit does not detect that the pressing member is at the lower end position in a case where the pressing member is moved into the storage bag, and contacts with sheets stored in the storage bag.

7. The sheet handling apparatus according to claim 1, wherein the number of sheets stored in the storage bag is calculated based on a recognition result by the recognition unit.

8. The sheet handling apparatus according to claim 1, further comprising a process mode setting unit configured to set one of a first process mode and a second process mode, as a process mode for an operation of storing a sheet in the storage bag held by the holding unit, wherein:

in a case where the process mode setting unit sets the first process mode for performing the operation of storing the sheet in the storage bag, the controller stops the operation of storing the sheet in the storage bag on the condition that the number of sheets received by the number information receiving unit is less than the predetermined number, when a distance between the stage and the pressing member that is pressing the sheets stored in the storage bag held by the holding unit, toward the stage, is greater than the predetermined distance, and in a case where the process mode setting unit sets the second process mode for performing the operation of storing the sheet in the storage bag, the controller does not stop the operation of storing the sheet in the storage bag even if the number of sheets received by the number information receiving unit is less than the predetermined number when the distance between the stage and the pressing member that is pressing the sheets stored in the storage bag held by the holding unit, toward the stage, is greater than the predetermined distance.

9. The sheet handling apparatus according to claim 1, further comprising a stage position detection unit configured to detect a position of the stage being movable in a predetermined movement range in the vertical direction, wherein the stage position detection unit comprises a first sensor configured to detect a second to-be-detected member mounted to the stage when the stage is positioned at a lower end in the predetermined movement range, and a second sensor disposed above the first sensor configured to detect the position of the stage when the bag held by the holding unit is in full state or nearly full state.

* * * * *